US006055924A

United States Patent [19]

Marshall et al.

[11] Patent Number: 6,055,924

[45] Date of Patent: May 2, 2000

[54] FOIL ASSISTED MARINE TOWING

[75] Inventors: Jason T. Marshall; John M. Almeter, both of Chesapeake; Denis G. Bushey, Virginia Beach, all of Va.

[73] Assignee: The United States of America as represented by the Secretary of the Navy, Washington, D.C.

[21] Appl. No.: 09/131,227

[22] Filed: Aug. 7, 1998

[51] Int. Cl.[7] ..... B63B 21/56

[52] U.S. Cl. ..... 114/242; 114/274

[58] Field of Search ..... 114/274, 280, 114/282, 242, 249, 253, 259, 258

[56] References Cited

U.S. PATENT DOCUMENTS

| | | | |
|---|---|---|---|
| 2,751,612 | 6/1956 | Shepard . | |
| 2,815,518 | 12/1957 | Kuehn . | |
| 2,832,304 | 4/1958 | Elyosius et al. | 114/280 |
| 3,019,755 | 2/1962 | Diamond | 114/274 |
| 3,121,890 | 2/1964 | Rumsey, Jr. . | |
| 3,164,119 | 1/1965 | Emmanuel et al. . | |
| 3,479,980 | 11/1969 | Simmons . | |
| 3,604,031 | 9/1971 | Cahill . | |
| 3,613,622 | 10/1971 | Bueller . | |
| 3,747,138 | 7/1973 | Morgan . | |
| 3,842,786 | 10/1974 | Uroshevich . | |
| 4,227,479 | 10/1980 | Gertler et al. . | |
| 4,685,691 | 8/1987 | Tremblay . | |
| 4,729,333 | 3/1988 | Kirby et al. . | |
| 4,955,312 | 9/1990 | Magazzu' . | |
| 5,062,378 | 11/1991 | Bateman . | |
| 5,100,354 | 3/1992 | Woolley et al. . | |
| 5,249,998 | 10/1993 | Woolley et al. . | |
| 5,927,226 | 7/1999 | Patterson | 114/249 |

FOREIGN PATENT DOCUMENTS

| | | | |
|---|---|---|---|
| 764151 | 7/1949 | Germany | 114/259 |
| 406048375 | 2/1994 | Japan | 114/274 |

*Primary Examiner*—Ed Swinehart
*Attorney, Agent, or Firm*—Howard Kaiser

[57] ABSTRACT

The invention permits and promotes high speed water towing by uniquely implementing hydrofoil technology in association with a trailer vehicle. According to many inventive embodiments, a hydrofoil component (comprising one or more foils) is placed in the aft half region of the trailer vehicle; however, the front half region of the trailer vehicle is devoid of hydrofoil structure. The trailer vehicle is adaptable to a semi-rigidly towably connective relationship with a tractor vehicle. When the trailer vehicle is towed by the tractor vehicle at design speeds, most of the weight of the trailer vehicle is supported by the hydrofoil component, while the remaining weight is supported by the tractor vehicle. The invention avails benefits of hydrofoil use, but averts or allays difficulties which are customarily encountered with hydrofoil use.

20 Claims, 15 Drawing Sheets

FOIL ASSISTED MARINE TOWING

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to methods, apparatuses and systems of transportation, more particularly to water transportation which involves towing.

There are many conventional transportive applications wherein a vehicle draws or pulls another vehicle which thereby follows behind. Some towing arrangements, such as a tractor-trailer "rig" on the highway, or a tugboat pulling a ship in the harbor, are especially familiar sights. Towing has a long and profitable history in both land and marine transportation. The notion of "towing" can entail the transporting of anything, whether it be passenger or cargo. In a narrower sense, the term "cargo" refers to freight. In a broader sense, the term "cargo" encompasses a diversity of animate and inanimate entities.

Some marine applications involve the towing of such objects as boats or equipment behind larger craft. These arrangements may be occasioned by the impracticality of stowing the object in the larger craft, or by the inability of the larger craft to load and/or unload the object. Particularly with regard to naval ships and other military water craft, towing may be necessitated by dimensional limitations imposed by transportation requirements or other requirements. In addition, marine applications involving the towing of passengers, though not yet prevalent, are within the realm of future possibility.

All over the world, "tugs" tow a variety of barges in a variety of ways. Commercial marine towing is traditionally performed at modest speeds, typically under ten knots. These lower speeds are adequate for low price bulk cargo such as iron ore, but are often inadequate for perishable or finished goods. Current trends in commercial marine transport are toward travel at greater transport speeds (ten knots or greater), especially for certain high value cargo.

High speed water transport of cargo and passengers is thus becoming increasingly important in the commercial transport industry. This may be especially true in Asia, where there is greater reliance on water transport than in the United States. In the United States, there has been a boom in the high speed ferry market; however, the ferries built to meet this demand have largely been of foreign design.

The U.S. Navy has a vital interest in high speed towing and surface transport of boats and other equipment. For example, MK V patrol boats and PC patrol craft are utilized for purposes of towing or otherwise transporting small boats, submersibles and other cargo. Due to the high speeds and great distances which are required by maneuver warfare in a littoral environment, the U.S. Navy places great emphasis on its ability to expeditiously move cargo and equipment from the ships to the shore.

Currently, military craft attempt to perform high-speed towing operations using a relatively long hawser. Such utilization of a cable or rope for towing purposes is generally unsatisfactory; in particular, it increases the probability of damage to both the towing craft and the towed craft, and it places severe operational restraints on the towed craft. The restriction of the towed craft's maneuverability due to the long hawsers is undesirable for missions which require high maneuverability.

Foreign countries and companies are making significant investments in high speed water transport technology. Investment by the United States in a viable concept for high speed water transport could benefit the domestic high speed water transport industry and provide significant export opportunities for U.S. industries.

Naval/marine architects and engineers are adopting various approaches in recognition of the emerging need for high speed towing. Nevertheless, in order for high speed towing to be accomplished efficiently and effectively, it must be both technically and economically feasible. Control, resistance and loading are major technical issues. Economic issues include initial procurement, maintenance, fuel and manning costs.

SUMMARY OF THE INVENTION

In view of the foregoing, it is a principal object of the present invention to provide method and apparatus for effectively and efficiently accomplishing high speed marine towing.

Depending on its context, the term "hydrofoil" is commonly understood to refer either to (i) a foil operating in water, or to (ii) a water vehicle which is equipped with at least one such foil. Various types of hydrofoil craft ("hydrofoils") have been known to the world for many years.

With regard to towing, the implementation of hydrofoil means is known in association with small personal towable water vehicles, such as water skis, which are used for recreative purposes; such recreational vehicles typically implement a flexible line-type member (e.g., a rope, cable, cord, etc.) for connecting to a tractor vehicle.

What has not been observed, however, is the present invention's implementation of hydrofoil means in association with generally larger towable water vehicles having hullforms which can accommodate passengers and/or diverse cargo for transportation (e.g., logistical) purposes. Nor has been observed the present invention's implementation of a "semi-rigid" connection between a marine tractor vehicle and a marine trailer vehicle. Nor has been observed the present invention's implementation of hydrofoil means in such a way as to provide "partial" hydrofoil support for a marine trailer vehicle.

The present invention uniquely features the endowment of a water vehicle with hydrofoil capability so as to enhance the "towability" of the water vehicle. The inventive equipping of a water vehicle with at least one foil (hydrofoil) serves to adapt the water vehicle to being towed in the context of an inventive high-speed marine towing regime.

In accordance with the present invention, a towable water vehicle comprises a hullform, a hydrofoil unit and means for coupling the hydrofoil unit with the hullform. The hydrofoil unit includes at least one foil.

According to more usual inventive practice, one or more hydrofoils are disposed within the back half region of the towable water vehicle, while the front half region of the towable water vehicle is devoid of hydrofoil structure. In other words, the inventive towable water vehicle has (can be considered to be characterized by) an imaginary planar bisector which divides the vessel into a fore section and an aft section. For many inventive embodiments, the hydrofoil unit is preferably situated in the aft section of the inventive towable water vehicle, while no foil whatsoever is situated in the fore section of the inventive towable water vehicle. Nevertheless, some inventive embodiments will require situation of the hydrofoil unit in the fore section of the inventive towable water vehicle.

Insofar as hydrofoil location is concerned, inventive practice will generally include consideration of pertinent parameters involving weight distribution. Placement of the hydrofoil unit will typically be determined, at least in part, on the basis of (i) the center (or centers) of gravity of the cargo, and (ii) the position of the cargo with respect to the invention's trailer water vehicle. Generally speaking, the location(s) of the hydrofoil(s) should comport with or "match" the location (s) of the center(s) of gravity.

If, for instance, the cargo intended to be carried has a single center of gravity and is expected to be held in a certain position in relation to the trailer vehicle, the hydrofoil unit may preferably be situated so as to be approximately even with (approximately vertically below) the cargo's center of gravity. If, as another example, such cargo has two centers of gravity (e.g., a major center of gravity and a minor center of gravity), the hydrofoil unit may preferably be situated so that some hydrofoil structure is approximately even with (approximately vertically below) each center of gravity, whereby the hydrofoil unit is configured in proportion to, or as a function of, the relative values of the two centers of gravity. The ordinarily skilled hydrodynamicist, marine architect or engineer who practices the present invention can be expected to apply basic principles of hydrodynamics and cargo weight distribution to the question of optimal placement of the hydrofoil structure.

This invention is appropriately designated a "Foil Assisted System for Towing," or the acronymous "FAST." The FAST according to this invention thus uniquely features the semi-rigid, closely coupled towing of craft or other payloads using partial hydrofoil support.

The inventive towing system is analogous to a highway tractor-trailer "rig" (truck). The basic commonality lies in the existence of a tractor component and a trailer component. In accordance with the present invention, the towed object is semi-rigidly coupled with the towing craft at the stern (e.g., transom), similar to the manner in which a "semitrailer" (the trailer component) is semi-rigidly coupled with a tractor truck. The trailer component of a tractor-trailer rig is supported at its forward (front) end by the aft (back) end of the tractor component; similarly, this invention's towable water vehicle (the trailer component) is supported at its front end by the stern of the towing water vehicle (the tractor component). The trailer component of a tractor-trailer rig is supported at its back end by tires; similarly, this invention's towable water vehicle (the trailer component) is supported at its back end by a hydrofoil configuration which includes one or more hydrofoils.

The *Maryland Trucking Handbook*, 1996 edition, in its glossary (appendix A) defines "full trailer" as "a vehicle without motive power, designed for carrying persons or property and for being drawn by a motor vehicle and so constructed that no part of its weight and that of its load rests upon or is carried by the towing vehicle." The same The *Maryland Trucking Handbook* defines "semitrailer" as "a vehicle without motive power, designed for carrying persons or property and for being drawn by a motor vehicle and so constructed that part of its weight and that of its load rests upon or is carried by the towing vehicle."

The *Glossary of Truck Terms, first edition, August* 1995, prepared by the Truck Writers of North America (TWNA), 600 Reisterstown Road, Suite 404, Baltimore, Md., 21208, also provides some pertinent definitions: A "truck" is a "vehicle which carries cargo in a body mounted to its chassis, rather than on a trailer towed by the vehicle." A "tractor" is a "truck designed to pull a semitrailer by means of a fifth wheel mounted over the rear axle(s). Sometimes called a truck tractor or highway tractor to differentiate it from a farm tractor." A "semitrailer" is a "truck trailer supported at the rear by its own wheels and at the front by a fifth wheel mounted to a tractor or dolly." A "tractor trailer" is a "tractor and semitrailer combination." A "fifth wheel" is a "coupling device attached to a tractor or dolly which supports the front of a semitrailer and locks it to the tractor or dolly. The fifth wheel's center is designed to accept a trailer's kingpin, around which the trailer and tractor or dolly pivot in turns." A "sliding fifth wheel" is a"fifth wheel mounted to a mechanism that allows it to be moved back and forth for the purpose of adjusting the distribution of weight on the tractor's axles. Also provides the capability to vary vehicle combination lengths." A "converter dolly (dolly)" is an "auxiliary axle assembly equipped with a fifth wheel (coupling device), towed by a semitrailer and supporting the front of, and towing, another semitrailer." A "kingpin (trailer) is an" anchor pin at the center of a semitrailer's upper coupler which is captured by the locking jaws of a tractor's fifth wheel to attach the tractor to the semitrailer." "Doubles (twins, twin trailers)" are a "combination of a tractor and two semitrailers connected in tandem by a converter dolly." A "pintle hook" is a "coupling device used in double trailer, triple trailer and truck-trailer combinations. It has a curved, fixed towing horn and an upper latch that opens to accept the drawbar eye of a trailer or dolly."

The ordinarily skilled artisan is well acquainted with the various systems and methodologies for connecting or "hitching" a semitrailer to a tractor truck. It is readily understood how these teachings and principles for the close and "semi-rigid" coupling of tractor and trailer land vehicles are applicable to the coupling of tractor and trailer marline vehicles in accordance with the present invention. Particularly familiar are the genre of coupling apparatus known as a "fifth wheel."

For example, the "U.S. Patent Classification System," set forth in the *Manual of Classification*, categorizes technology in terms of "classes" and "subclasses." Class 280 is entitled "Land Vehicles." Within class 280, subclass 29 is entitled "WHEELED." Subordinate to subclass 29 is subclass 400, entitled "Articulated vehicle. Subordinate to subclass 400 is subclass 423.1, entitled "Semitrailer." In the class 280 hierarcy, subclasses 423.1 through 441.2 are all encompassed by subclass 423.1. The "*Classification Definitions*" define the nature of the subject matter found in particular classes and subclasses. Subclass 423.1, entitled "Semitrailer," is defined thusly: "Vehicles under subclass 400 in which there is provides a tractor capable of independent use and an unbalanced trailing vehicle having running gear at the rear end thereof, the forward end of the trailer being supported on the back of the tractor at or forward of the rear axle of the tractor by an articulated connection or fifth wheel which connection transmits all of the draft." Subclasses 434 through 441.1 are subordinate to subclass 433. Subclass 433, subordinate to subclass 423.1 and entitled "Fifth wheel only," is defined thusly: "Devices under subclass 423.1 directed to the means by which the tractor and semitrailer are releasably and articulatively connected and including no more of the vehicle structure than is necessary to mount the connecting means." Subclass 441.2, subordinate to subclass 423.1 and entitled "Detachable or shiftable gooseneck type," is defined thusly:

"Vehicles under subclass 423.1 in which the trailer includes an inverted L or U shaped member the forward end of which carries an articulated connection at a higher elevation than the load body and in which the L or U shaped member may be disconnected, raised, or lowered from the trailer principally to enable the trailer to come closer to the ground for loading."

The following exemplary U.S. patents, incorporated herein by reference, are classified in class 280 and in at least one subclass therein between subclass 423.1 and subclass 441.2 inclusive: Melton U.S. Pat. No. 3,659,876; Bott U.S. Pat. No. 3,677,563; Burrows et al. U.S. Pat. No. 3,706,464; Schaffart et al. U.S. Pat. No. 3,751,070; Hixon U.S. Pat. No. 3,796,444; Leland U.S. Pat. No. 3,820,821; Damm U.S. Pat. No. 3,884,503; Kent et al. U.S. Pat. No. 3,924,909; Horton U.S. Pat. No. 4,067,592; Capps U.S. Pat. No. 4,119,330; Kornahrens U.S. Pat. No. 4,260,173; Fagerstedt U.S. Pat. No. 4,391,455; Mittelstadt U.S. Pat. No. 4,359,234; Hebert U.S. Pat. No. 4,438,943; Erwin U.S. Pat. No. 4,667,976; Schultz et al. U.S. Pat. No. 4,720,118; Bennett U.S. Pat. No. 4,993,738; Evans U.S. Pat. No. 5,040,815; Vick U.S. Pat. No. 5,060,964; Noah et al. U.S. Pat. No. 5,226,675; Madsen et al. U.S. Pat. No. 5,456,483; Dudzik et al. U.S. Pat. No. 5,730,454.

In accordance with many embodiments of this invention, the stern of the towing craft supports a relatively small percentage of the weight of the towed craft. A hydrofoil arrangement (comprising at least one hydrofoil) dynamically supports the majority of the towed weight when being towed at high speeds. At lower speeds, hydrostatic forces predominately support the towed craft. The invention's basic operative principle is in keeping with the basic operative principle of a conventional hydrofoil vessel, which typically includes a boat-shaped hull and one or more hydrofoils attached thereto.

To elaborate, a hydrofoil is fundamentally a foil (wing) which generates lift as it travels through water, in much the same way that an airfoil (aircraft wing) generates lift as it travels through the air. According to Bernoulli's principle, the faster a fluid moves, the lower the pressure the fluid exerts upon objects along which the fluid flows. The curved upper surface of the foil causes fluid to flow at higher speeds above it than beneath it, resulting in a difference of pressure between the foil's upper surface and the foil's lower surface; that is, the fluid flowing over the curved upper surface has to move faster than the fluid flowing beneath the lower surface, resulting in a reduction of pressure on the upper surface and an increase of pressure on the lower surface. A notable practical distinction between a hydrofoil and an airfoil is that, since water is considerably denser than air, a hydrofoil can be designed to be much smaller than an airfoil for the same amount of lift.

When a conventional hydrofoil craft attains sufficient speed, the lift provided by the flow of water over the hydrofoil raises the hydrofoil's hull out of (entirely clear of) the water. In theory at least, once the hull is completely out of the water, the hull no longer undergoes resistance due to friction with the water, or due to waves in rough water; hence, the hydrofoil achieves higher speeds and a more stable ride.

Although a hydrofoil is fairly simple conceptually, historically the hydrofoil has proven rather difficult to effectuate well in practice. The hydrofoil is an attractive concept because of its potential for extremely low resistance when "on foil." This translates to reductions in horsepower requirements and fuel consumption. Various problems associated with hydrofoils have prevented their widespread use; these problems include the following: control (e.g., motion control); stability; propulsion (i.e., propelling a hydrofoil vehicle); spray (e.g., the struts generate a large amount of spray, which strikes the craft and increases its drag); complexity (e.g., with respect to propulsion).

Some conventional approaches to minimizing the vexing problems associated with hydrofoils involve "hybridization" of the hydrofoil vehicle. Basically speaking, a "hybrid hydrofoil" craft is part hydrofoil, some other type of craft. Examples of hybrid hydrofoils which are commercially available from U.S. manufacturers include the Techno-Superliner, the Super Shuttle 400 and the Foilcat 2900.

Hybrid hydrofoils have been in operation in the former Soviet Union for quite some time. For instance, their Turya and Matka classes of craft are each a combination of a semi-planing hull and a hydrofoil. The aft end of the craft is supported by the craft's own bottom; the forward end of the craft is supported by a hydrofoil configuration. These craft displace about 250 tons. This hybridization approach provides stability and control and allows a conventional inboard propeller propulsion.

The inventive FAST uniquely avails a sort of hybridization strategy. In a sense, the inventive FAST can be understood to be a hybrid hydrofoil system. According to the inventive FAST, the forward end of the towed craft is supported by the stern of the towing craft; the aft end of the towed craft is supported by a hydrofoil configuration. Hence, a comparison can be drawn between the inventive FAST and a known hybrid hydrofoil insofar as considering each to constitute a single overall hybrid hydrofoil system. For example, when one compares the inventive FAST with the Russian Turya and Matka classes, it is seen that the inventive FAST provides the hybrid component in the front and the hydrofoil component in the back, whereas the Turya and the Matka classes each provide the hydrofoil component in the front and the hybrid component in the back.

The invention significantly differs from previous hybridization schemes in certain critical respects. The inventive concept of the closely-coupled towing of a hydrofoil by a conventional monohull is unknown outside of the present invention. Previous hybrid hydrofoils have entailed one craft, as distinguished from the two-craft, tractor-trailer rig-like arrangement of the inventive FAST.

Stability and control are inventively provided by the semi-rigid connection of the towing craft to the towed craft. In contrast to traditional or hybrid hydrofoil installations, the inventive semi-rigid connection limits typical pitches and surge motions. The inventive semi-rigid connection takes advantage of high lift-to-drag ratio while at the same time mitigating the aforenoted weaknesses normally associated with hydrofoil implementation. The propulsion system complexities which are characteristic of conventional hydrofoils are inventively avoided by the towing arrangement. The inventive absence of a forward hydrofoil circumvents the problem relating to spray generated by a forward hydrofoil and especially by one or more associated forward struts; the spray from the aft hydrofoil and associated aft strut or struts is distributed largely aft of the towed craft.

The inventors have considered the possibility, previously suggested by other people, of utilizing a "planing" trailer in a marine tractor-trailer regime. It is believed by the inventors that such a tractor-trailer arrangement would be problematical inasmuch as the planing trailer would have a comparatively low lift-to-drag ratio.

This invention affords a more cost-effective methodology for transporting passengers, boats, equipment, fuel bladders, cargo, etc. at high speeds. The inventive FATS affords a practical high speed towing capability which otherwise does not exist. Essentially, the inventive FAST avails the advantages of hydrofoils without incurring the disadvantages which have prevented the prevalent use of hydrofoils. The problem areas normally associated with hydrofoils (e.g., excessive spray drag, dynamic control/stability and propulsor complexity) are completely or largely avoided by the present invention's featured attachment, in a closely coupled, semi-rigid way, of a hydrofoil trailer to a high speed towing craft.

The inventive FAST has both commercial and military applications. As noted hereinabove, although towing has traditionally been performed at very low speeds, there is an emerging need in the commercial industry for highspeed water transport of goods and passengers. In addition, the need frequently arises for military boats and ships such as the MK V Special Operations Craft and PC Patrol Craft to perform high-speed tows of small boats, submersibles and other cargo. The inventive FAST accomplishes high speed towing without resort to deficient techniques which are currently in vogue, such as involving the implementation of hawsers or complex loading systems.

This multifarious applicability of the present invention admits transportation in any water or marine environment, locality or milieu. The terms "water" and "marine," as used herein, are synonymous, and pertain to any body of water, natural or man-made, including but not limited to oceans, seas, gulfs, lakes, harbors, canals, rivers, straits, etc.

Other objects, advantages and features of this invention will become apparent from the following detailed description of the invention when considered in conjunction with the accompanying drawings.

BRIEF DESCRIPTION OF THE DRAWINGS

In order that the present invention may be clearly understood, it will now be described, by way of example, with reference to the accompanying drawings, wherein like numbers indicate the same or similar components, and wherein.

DETAILED DESCRIPTION OF THE INVENTION

Figure 1:
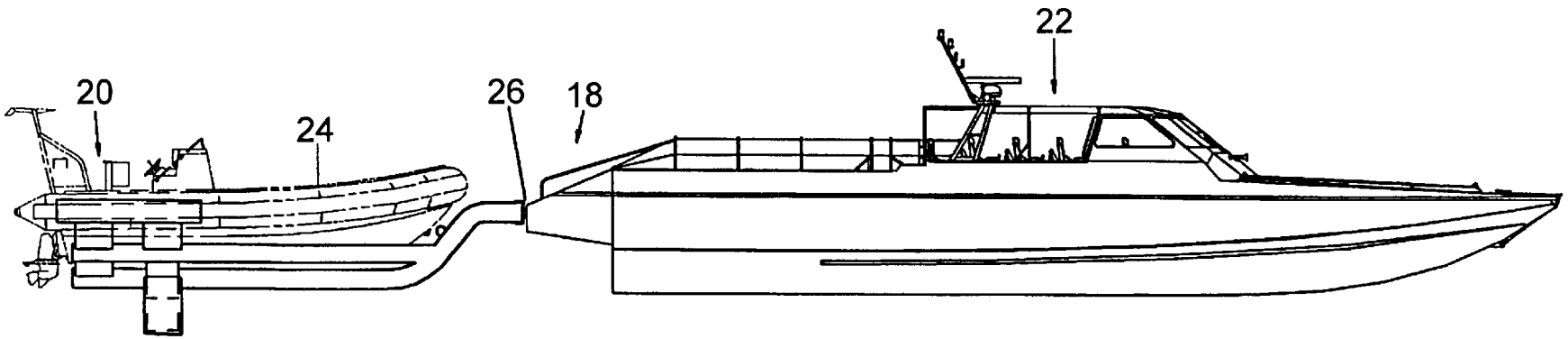
FIG. 1 is a diagrammatic elevational side view of an inventive embodiment of a FATS, including a tractor vehicle and a trailer vehicle.

Referring now to FIG. 1, a FAST according to this invention comprises trailer vehicle 20, tractor vehicle 22 and cargo 24. Tractor vehicle 22 is the towing craft. Trailer vehicle 20 is the towed craft. Tractor vehicle 22 and trailer vehicle 20 are closely coupled by means of towing connection 26.

Each of the three main components (trailer vehicle 20, tractor vehicle 22 and cargo 24) of a transportatively operational FAST admits of a variety of characteristics; accordingly, inventive practice demands a requisite degree of compatibility among these three main components. In particular, trailer vehicle 20 is configured and sized to suit and match tractor vehicle 22 and cargo 24.

Tractor vehicle 22 can be any high speed craft, including but not limited to patrol boat, crewboat, high speed towboat, etc. Trailer vehicle 20 and its components can be made of any one of or any combination of a diversity of materials, including but not limited to steel, aluminum and composites. Cargo 24 can include one or more animate and/or inanimate objects such as boats, submersibles, containers, pallets, etc. Cargo 24 can be situated in or on trailer vehicle 20 by any of various conventional techniques; for instance, cargo 24 can be floated or lifted into or onto trailer vehicle 20.

Towing connection 26 is described herein as being "semi-rigid"; that is, towing connection 26 to some extent permits mobility and to some extent restricts mobility. A "semi-rigid" connection is a connection which provides at least one "degree of freedom." Any of various known types of towing connections which are utilized in tractor-trailer rig contexts, aptly described by the term "semi-rigid," can similarly be utilized as towing connection 26 or as a component thereof.

The semi-rigidity of towing connection 26 should be characterized by a proper balance of flexibility (for permitting some amount of freedom of motion of trailer vehicle 20) and inflexibility (for affording some amount of restraint of motion of trailer vehicle 20). The partial limitation of the movability of trailer vehicle 20 is especially purposeful for precluding unwanted movements of trailer vehicle 20, such as roll, pitch, etc. The amount of restraint afforded by towing connection 26 depends on the design parameters of the inventive application, in particular with regard to the sizes, types, shapes and interrelationships of and among trailer vehicle 20, tractor vehicle 22 and cargo 24.

Figure 2:
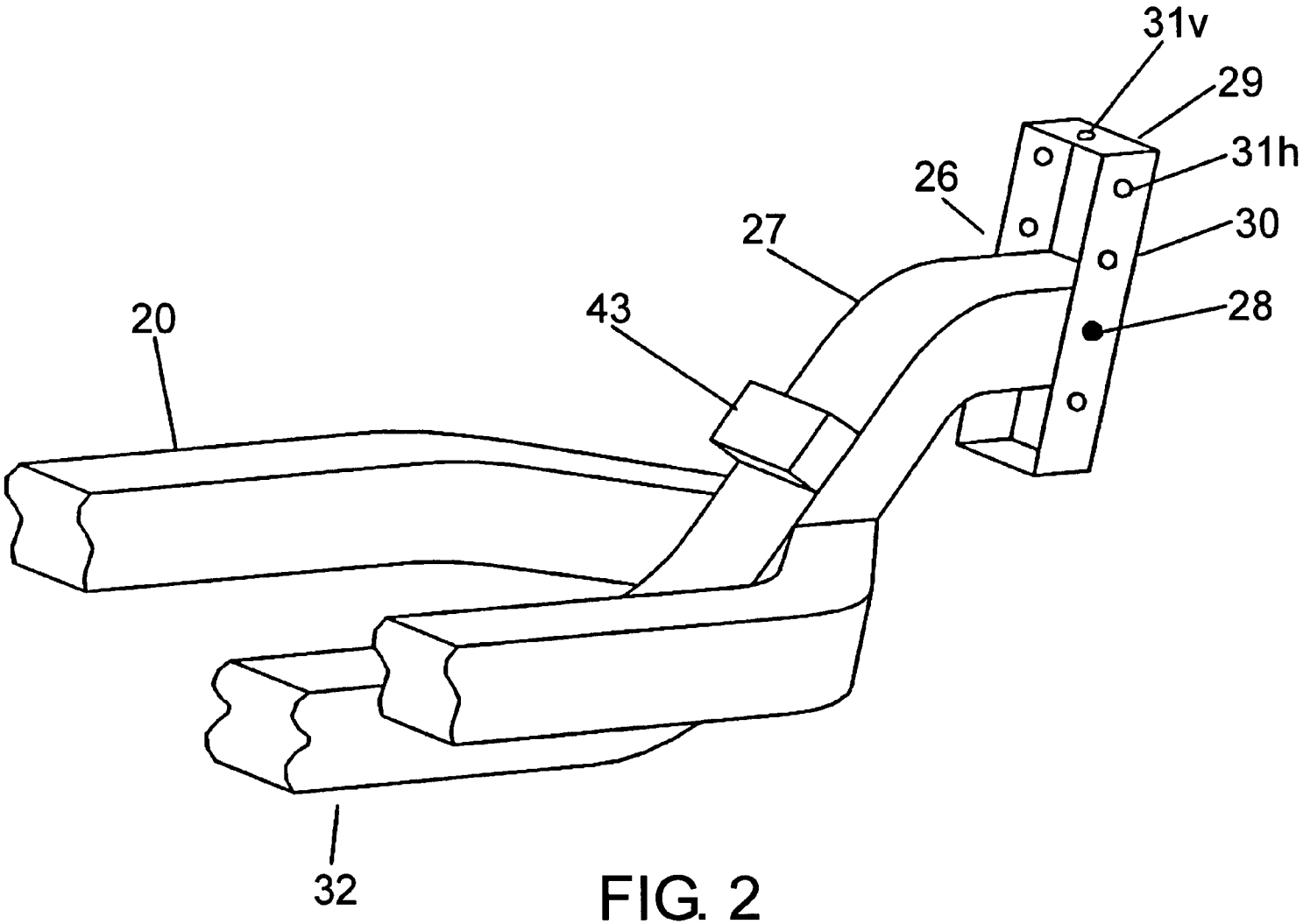
FIG. 2 is a diagrammatic exploded view of an inventive embodiment of a semi-rigid tractor-trailer connection assembly.
Figure 3:
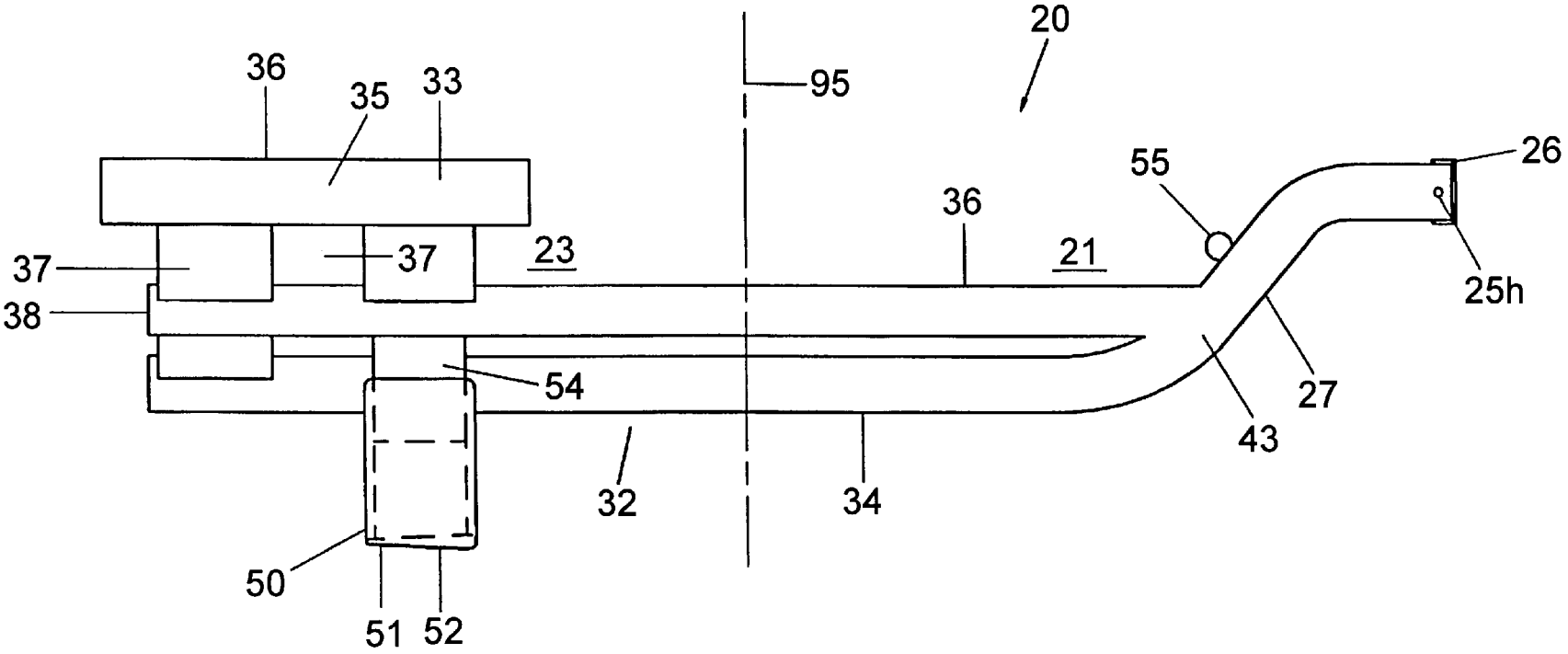
FIG. 3 is a diagrammatic elevational side view of an inventive embodiment of an "open-bottomed," "open-sided," "open-transomed" trailer vehicle which is equipped with a typical surface piercing hydrofoil configuration.
Figure 4:
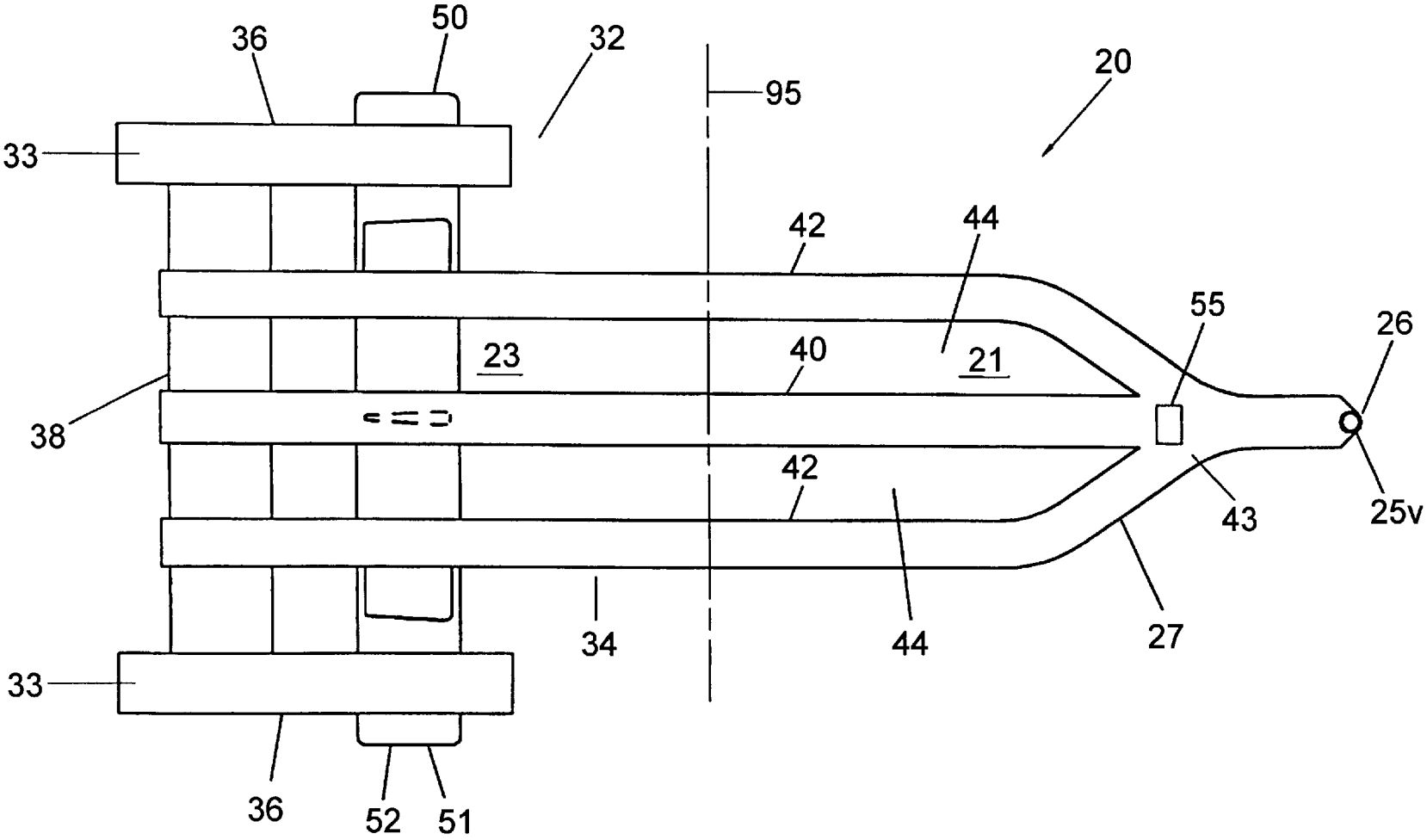
FIG. 4 is a diagrammatic top plan view of the inventive embodiment shown in FIG. 3.

With reference to FIG. 2, FIG. 3 and FIG. 4 and still with reference to FIG. 1, trailer vehicle 20 includes forward gooseneck 27, which is utilized for engagement purposes as part of towing connection 26. Towing connection 26 includes gooseneck 27, pin 28 and post 29. As is the case for many inventive embodiments, towing connection 26 has a "tongue load" associated therewith.

Post 29 is provided with two lateral sets of vertically aligned axially horizontal holes 31*h*. Each hole 31*h* of one lateral set is horizontally aligned with a corresponding hole 31*h* of the other lateral set. As shown in FIG. 3, gooseneck 27 is provided with axially horizontal bore 25*h*. Towing connection 26 is shown in FIG. 2 to be effected by alignedly disposing bore 25*h* between a corresponding pair of horizontally aligned holes 31*h*, and disposing pin 28 through the axially horizontal aperture defined by such holes 31*h* and bore 25*h*. Alternatively, towing connection 26 can be effected by alignedly disposing vertically axial bore 25*v* (provided in gooseneck 27 as shown in FIG. 4) between a corresponding pair of vertically axial, vertically aligned holes 31*v* (provided in post 29; one hole 31*v* shown in FIG. 2), and disposing pin 28 through the axially vertical aperture defined by such holes 31*v* and bore 25*v*.

Some inventive embodiments provide vertical adjustability of towing connection 26 with respect to either trailer vehicle 20 or tractor vehicle 22. As shown in FIG. 2, vertically adjustable coupling mechanism 30 includes pin 28 and post 29. In inventive practice generally, coupling mechanism 30 such as shown in FIG. 2 can be provided either at the forward end of trailer vehicle 20 or at the aft end of tractor vehicle 22. In this example, gooseneck 27 is provided at the front end of trailer vehicle 20, and vertically adjustable coupling mechanism 30 is provided at the back end of tractor vehicle 22; the vertical location at which gooseneck 27 engages coupling mechanism 30 is adjustable in terms of which pair is selected among the plurality of pairs of horizontally aligned holes 31*h*. The adjustment is made in furtherance of agreement or conformity between trailer vehicle 20 and tractor vehicle 22.

Some inventive embodiments afford pivoting capability of towing connection 26. Still referring to FIG. 2, pin 28 can be disposed through the horizontal aperture defined by horizontally aligned holes 31*h* and bore 25*h* in such a way as to provide pivotability of gooseneck 27 about the horizontal axis of such horizontal aperture. Such an arrangement would provide for towing connection 26 a single degree of freedom, viz., rotatability about the horizontal apertural axis defined by horizontally aligned holes 31*h* and bore 25*h*. Similarly, a single degree of freedom can be afforded by pivotability of gooseneck 27 about the vertical axis of the vertical aperture defined by vertically aligned holes 31*v* and bore 25*v*.

Some inventive embodiments afford more than one degree of freedom for towing connection 26. For example, it may be preferable for an inventive embodiment to avail the arrangement shown in FIG. 2 so as to provide a second degree of freedom, in another direction. Horizontal lateral (side-to-side) movability of gooseneck 27 can be provided along the horizontal axis of the aperture defined by horizontally aligned holes 31*h* and bore 25*h*. This horizontal movability can be facilitated by rendering post 29 at a significantly lesser width than the width of gooseneck 27. Similarly, a second degree of freedom can be afforded in the vertical (up-and-down) direction; vertical movability of gooseneck 27 is afforded along the vertical axis of the aperture defined by vertically aligned holes 31*v* and bore 25*v*.

The ordinarily skilled artisan is capable of selecting the appropriate towing connection 26 from among numerous conventional semi-rigid close-coupling methodologies so as to permit the desired movability, in terms of nature and extent, of trailer vehicle 20 with respect to tractor vehicle 22. In this regard, some inventive embodiments will preferably implement a flexible material such as rubber or another elastomer. For instance, additional "flexibility" would be imparted to the towing connection 26 arrangement shown in FIG. 2 if post 29 were, at least in part, made of a stiff elastomeric material.

Many other towing connection 26 arrangements would be apparent to the ordinarily skilled artisan, some of which would advantageously implement flexible material. For example, towing connection 26 can comprise a short, stiff piece of elastomer which functions as a rope analogue. Motion is restricted, yet some amount of motion is possible in nearly any direction. As another example, towing connection 26 can comprise a ball-and-socket joint; again, movability is limited, but there is a degree of some freedom corresponding to practically every direction.

Figure 11:
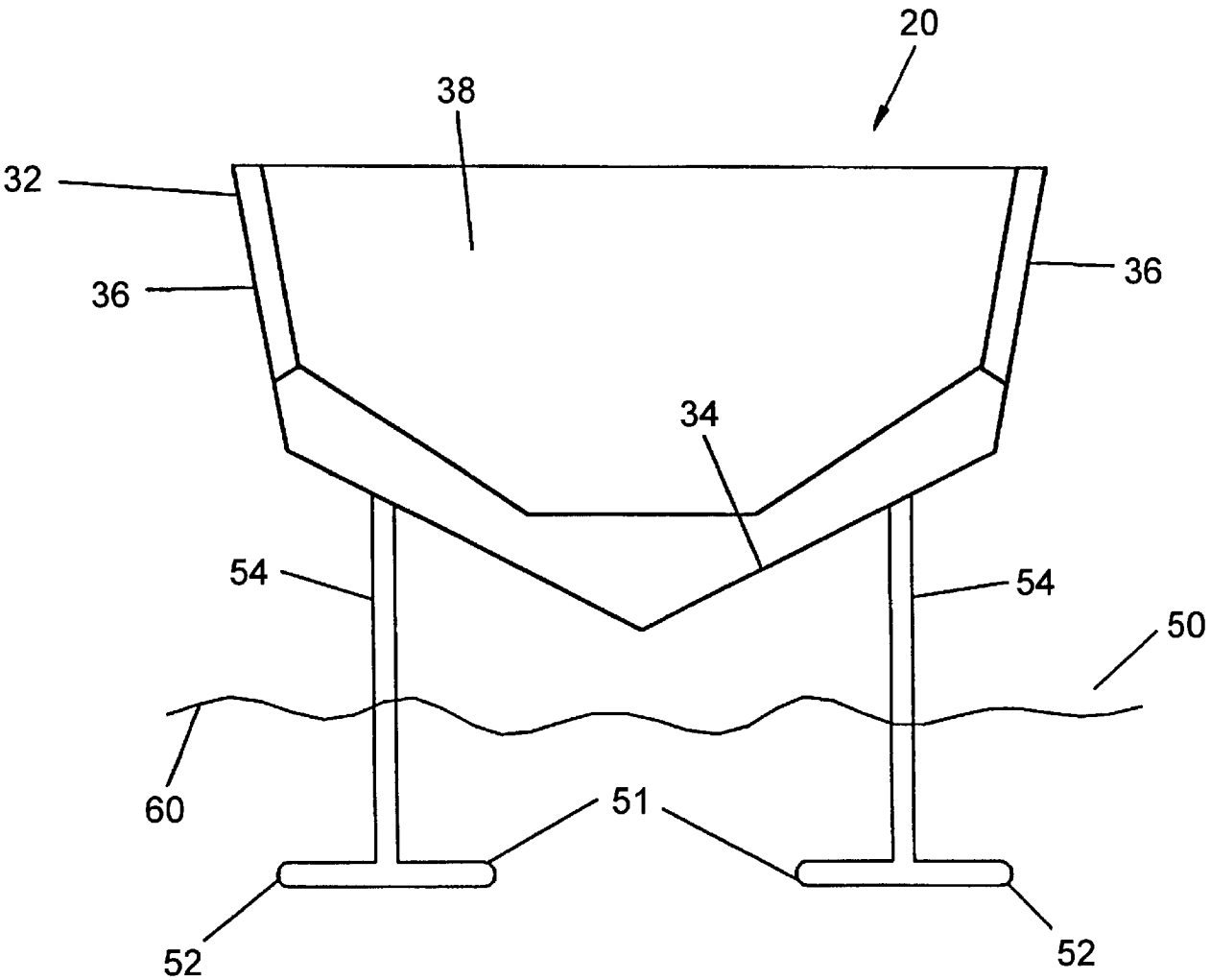
FIG. 11 and FIG. 12 are each a diagrammatic elevational back end view of an inventive embodiment of a completely "closed" ("closed-bottomed," "closed-sided," "closed-transomed") trailer vehicle which is suitable for carrying "dry" cargo" and which is equipped with a typical fully submerged hydrofoil configuration.
Figure 12:
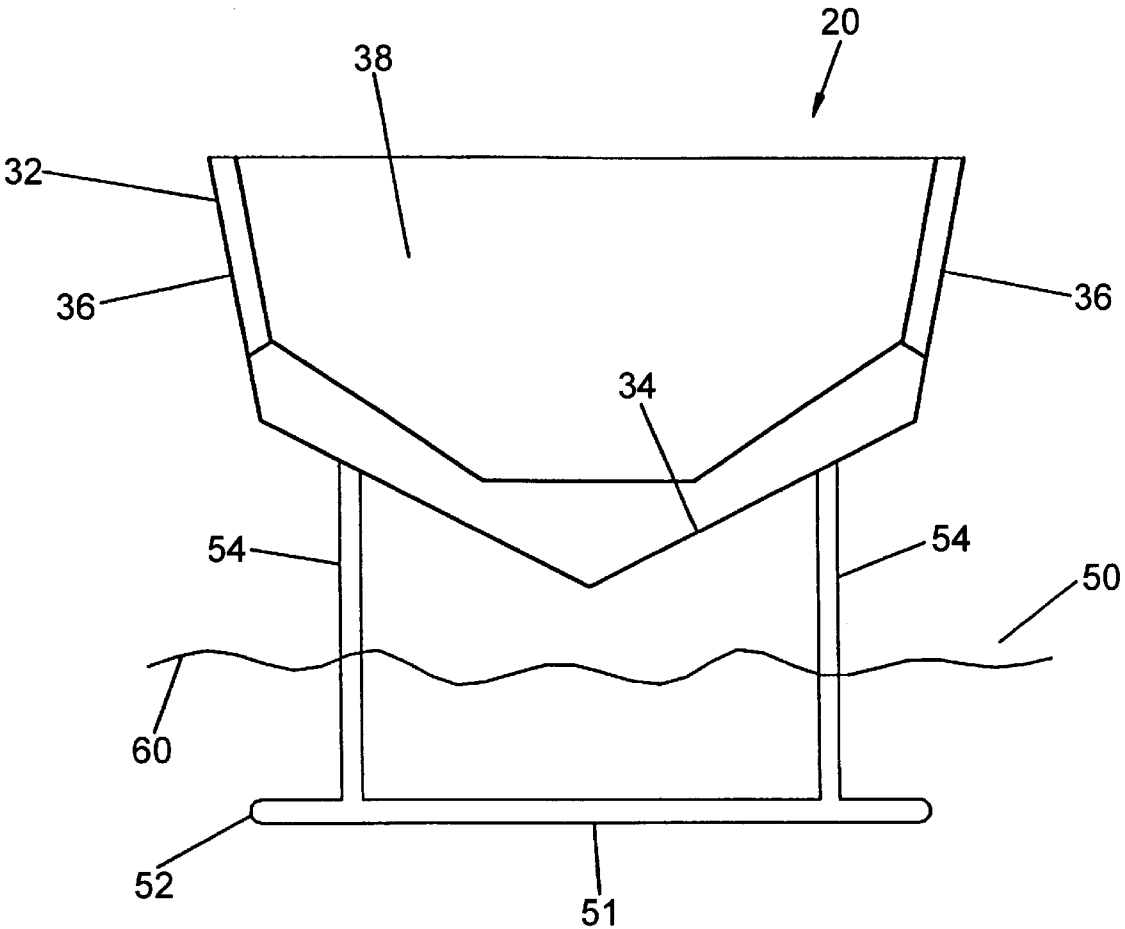
Figure 13:
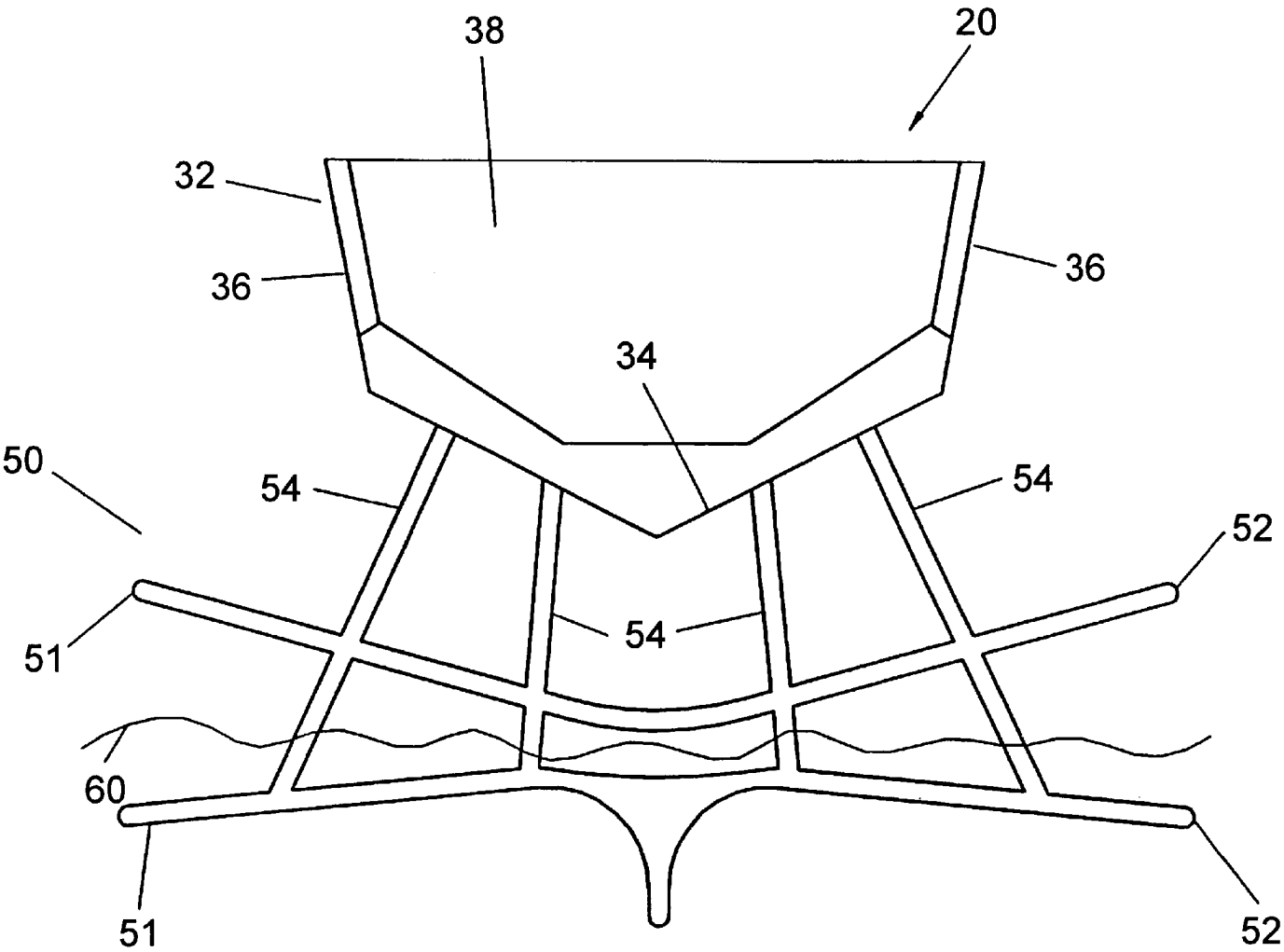
FIG. 13 is a diagrammatic elevational back end view of an inventive embodiment of a completely "closed" trailer vehicle (similar to the inventive embodiment shown in FIG. 11 and FIG. 12) which is equipped with a typical shallowly submerged hydrofoil configuration.
Figure 14:
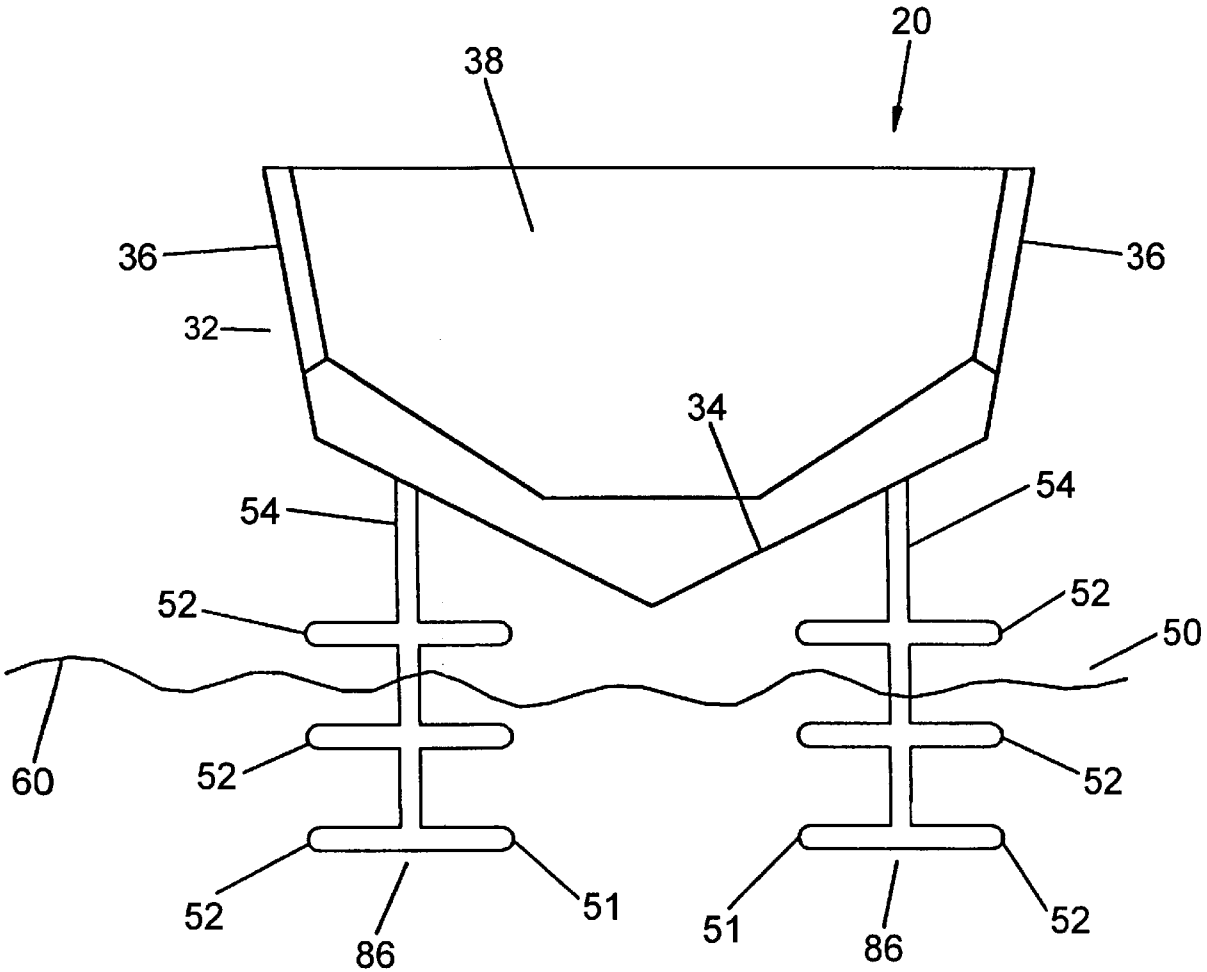
FIG. 14 and FIG. 15 are each a diagrammatic elevational back end view of an inventive embodiment of a completely "closed" trailer vehicle (similar to the inventive embodiment shown in FIG. 11 and FIG. 12) which is equipped with a typical ladder hydrofoil configuration, wherein the trailer vehicle is shown carrying the cargo as shown in FIG. 7
Figure 15:
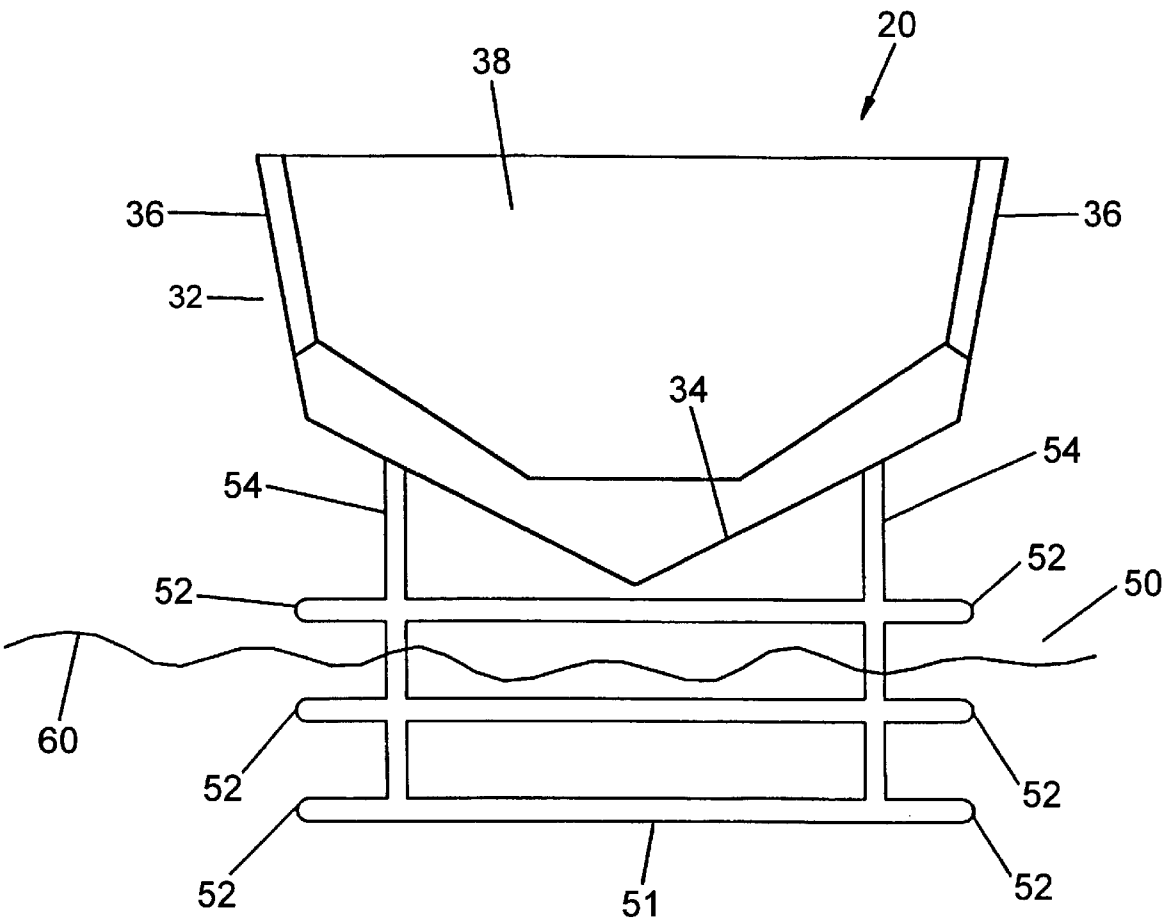

At high speeds, hydrofoil configuration 50 variously shown in the figures herein provides the majority of the dynamic support of trailer vehicle 20. Any of various conventional hydrofoil designs can be used, including but not limited to the following: surface piercing (such as shown in FIG. 3 through FIG. 10) fully submerged (such as shown in FIG. 11 and FIG. 12); shallowly submerged (such as shown in FIG. 13); ladder (such as shown in FIG. 14 and FIG. 15). Selection of the exact foil configuration 50 is dependent upon various inventive parameters, including but not limited to: the size of trailer vehicle 20; towing speed; type of towing connection 26; motions of trailer vehicle 20.

With reference to FIG. 3 through FIG. 7, inventive trailer vehicle 20 includes hullform 32 and hydrofoil configuration 50. Hullform 32 includes hull bottom 34, hull sides 36 and hull transom 38. Cargo 24 is a boat. Trailer vehicle 20 has forward half 21 and aft half 23. Medial demarcation 95, an imaginary vertical plane which appears linear as shown in the profile view of FIG. 3, separates forward half 21 and aft half 23. Hydrofoil configuration 50 includes hydrofoil unit 51 and struts 54. Hydrofoil unit 51 includes a single hydrofoil 52. Hydrofoil unit 51 is located in aft half 23. The term "hydrofoil unit 51," as used herein, essentially denotes the aggregate hydrofoil component of hydrofoil configuration 50—i.e., the sum or totality of all hydrofoils 52 which are included by hydrofoil configuration 50.

Figure 7:
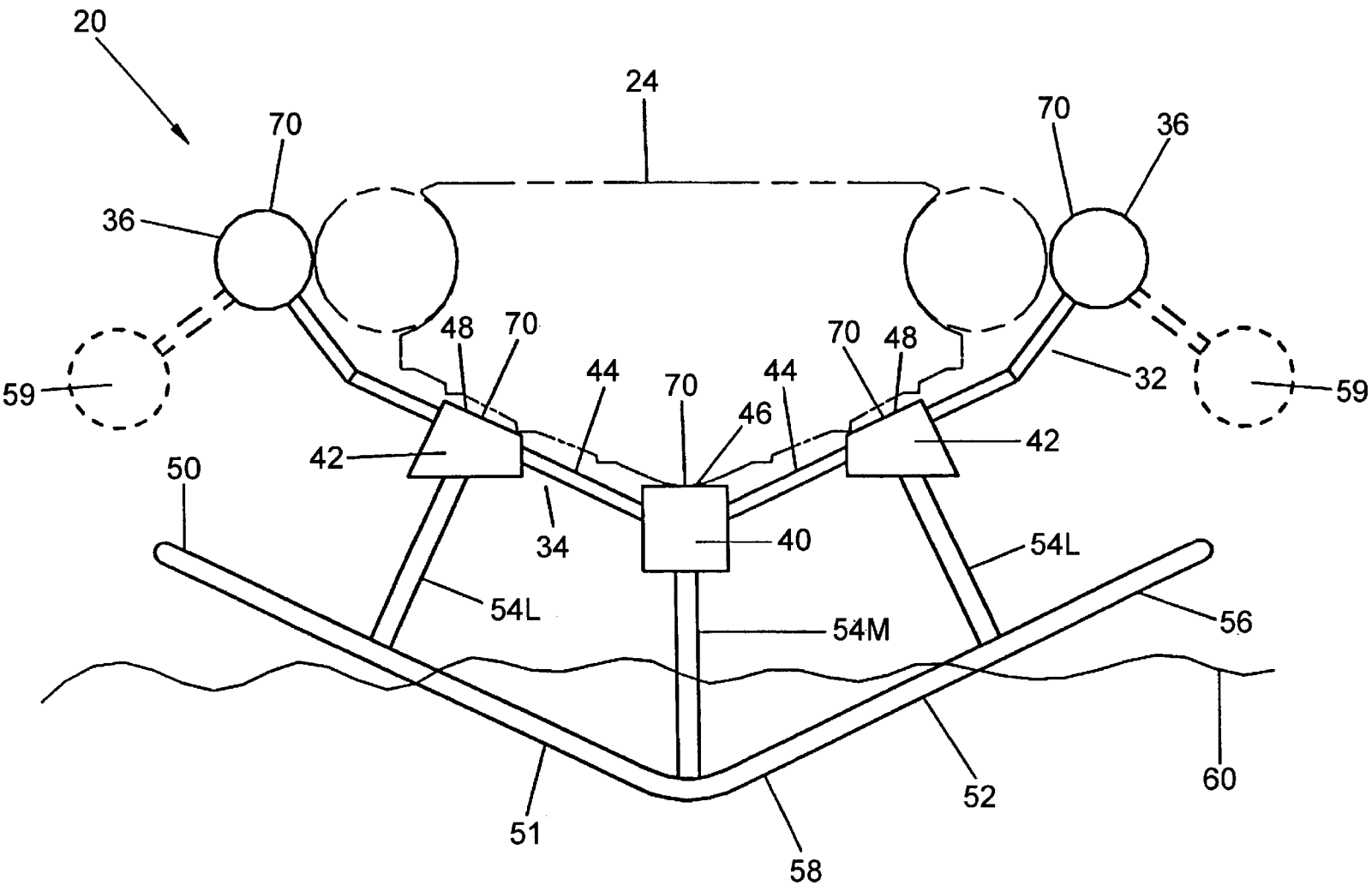
FIG. 7 is a diagrammatic elevational back end view of the inventive embodiment shown in FIG. 3, wherein the trailer vehicle is shown carrying the cargo (sans some structural detail of the cargo) as shown in FIG. 5.
Figure 8:
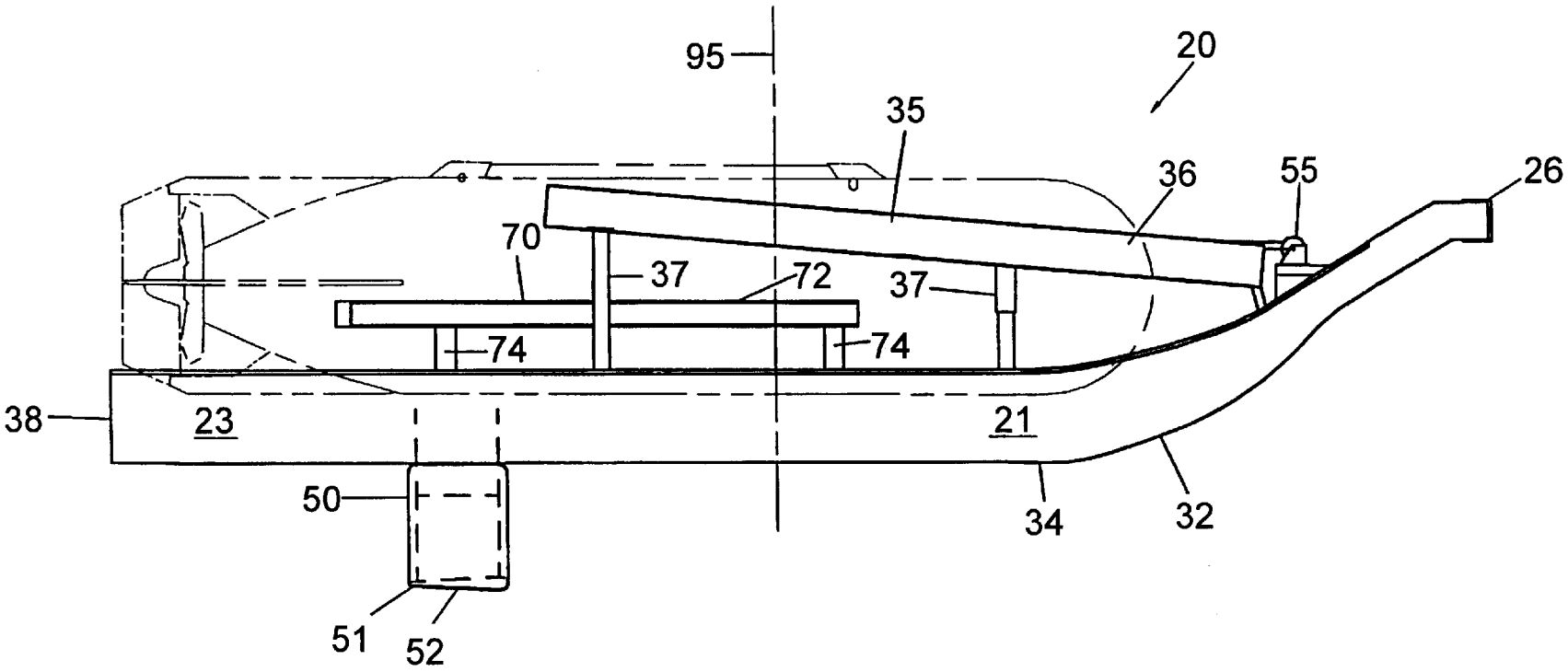
FIG. 8 is a diagrammatic elevational side view (similar to the view shown in FIG. 3) of an inventive embodiment (similar to the inventive embodiment shown in FIG. 3) of a "closed-bottomed," "open-sided," "open-transomed" trailer vehicle which is equipped with a typical surface piercing hydrofoil configuration, wherein the trailer vehicle is shown carrying cargo of a different kind from that shown in FIG. 5.
Figure 9:
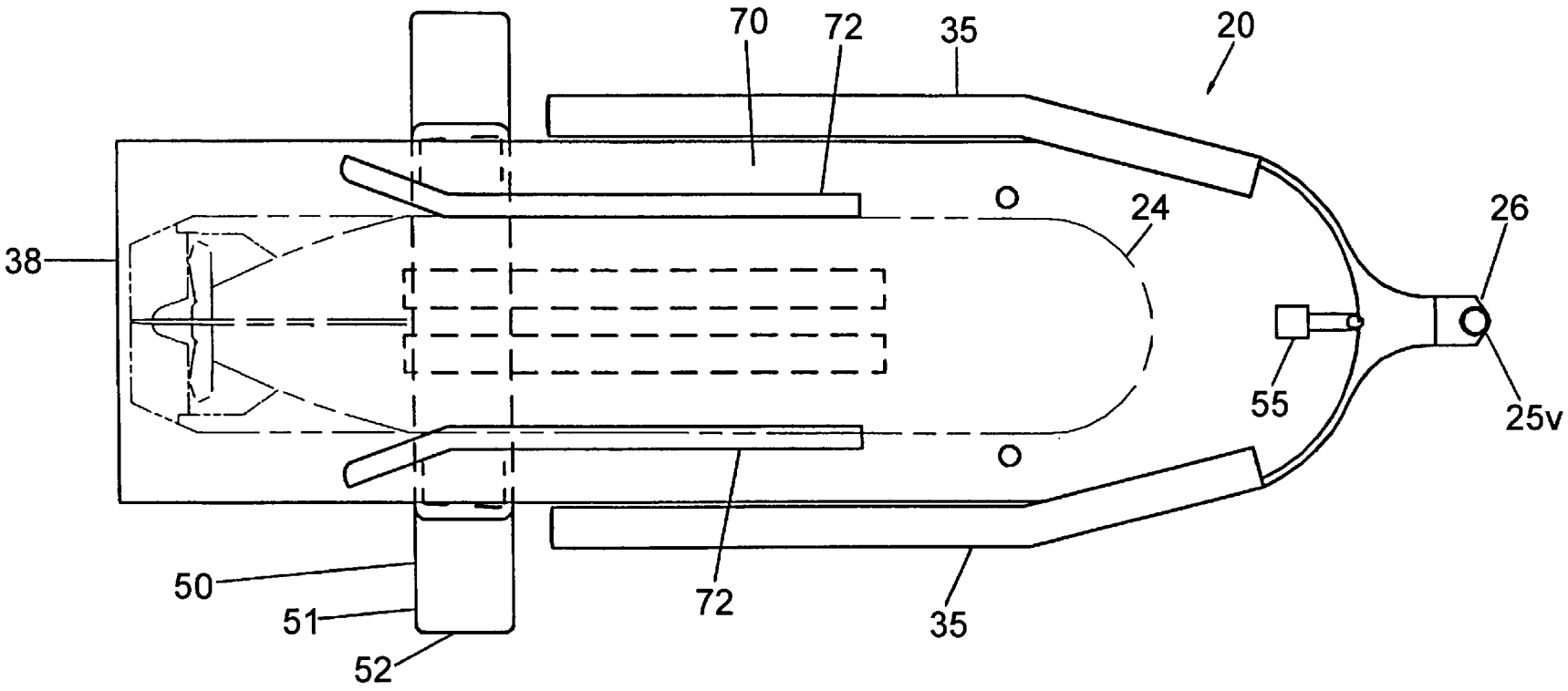
FIG. 9 is a diagrammatic top plan view of the inventive embodiment shown in FIG. 8, wherein the trailer vehicle is shown carrying the cargo as shown in FIG. 8.
Figure 10:
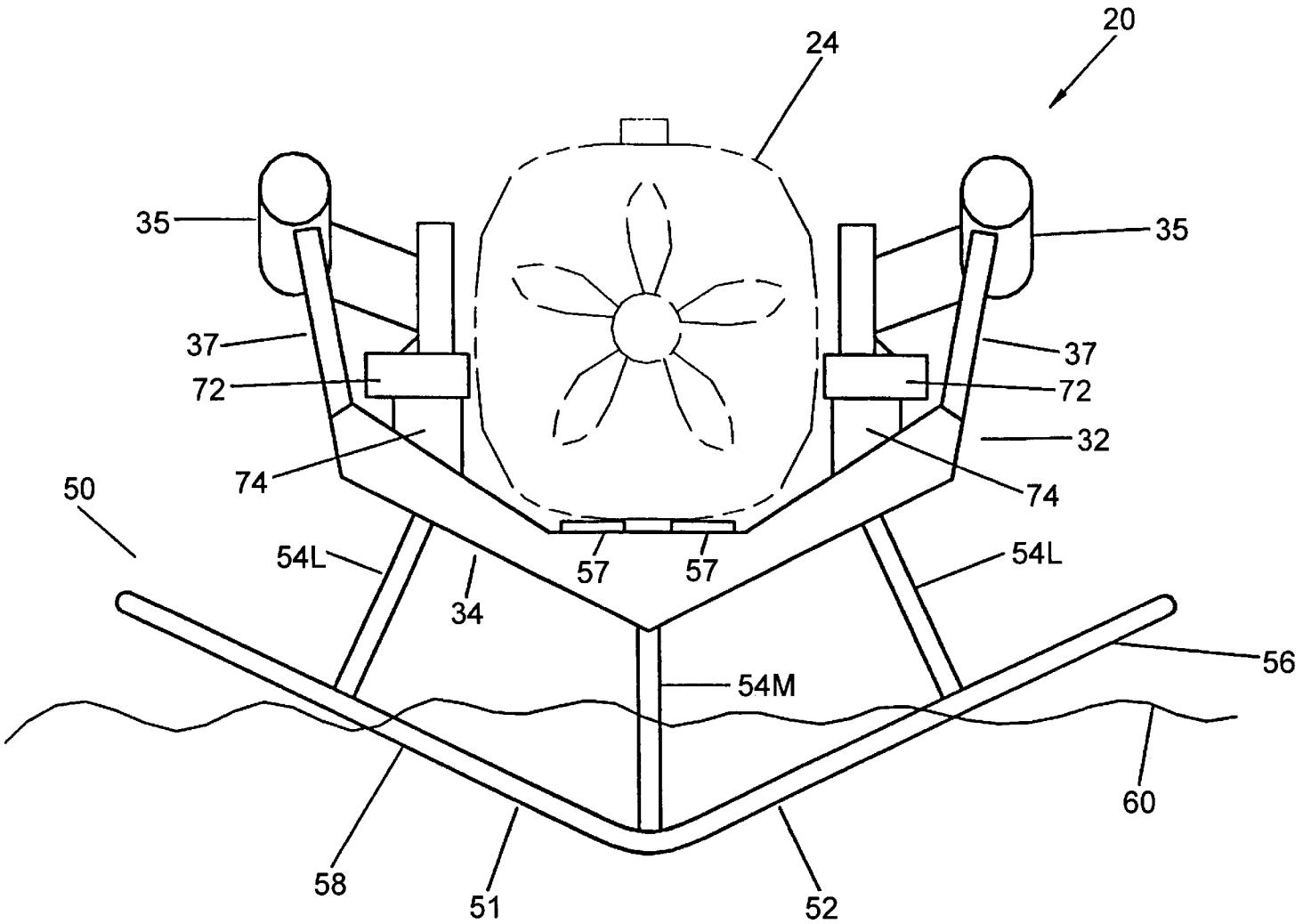
FIG. 10 is a diagrammatic elevational back end view of the inventive embodiment shown in FIG. 8, wherein the trailer vehicle is shown carrying the cargo (sans some structural detail of the cargo) as shown in FIG. 8.

Depending upon the inventive embodiment, each of bottom 34, sides 36 and transom 38 can be characterized by "openness" or "closedness." In inventive practice, bottom 34 can be either "open" (wherein bottom 34 has an "open" configuration such as shown in FIG. 3 through FIG. 7) or "closed (wherein bottom 34 has a "closed" configuration such as shown in FIG. 8 through FIG. 10). Whether bottom 34 is "open" or "closed" may depend upon the type of cargo to be transported.

Hullform 32 shown in FIG. 3 through FIG. 7 combines elements of a "V"-bottomed boat hull with elements of a barge or raft. As best shown in FIG. 4, bottom 34 has an "open" configuration in the sense of having one or more interspersed gaps or spaces; as thus viewed from above, bottom 34 appears to have a three-pronged configuration resembling that of a fork.

Bottom 34 as shown comprises three main longitudinal beam-like structural members, viz.—centerline girder 40 and a pair of lateral girders 42—which are integrated in symmetrical and discontinuous fashion. The two lateral girders 42 are mirror-image equivalents which are on opposite sides vis-a-vis' centerline girder 40.

Centerline girder 40 and lateral girders 42 are joined together so as to leave a pair of longitudinal openings 44 in bottom 34. The two longitudinal openings 44 are mirror-image equivalents which are on opposite sides vis-a-vis' centerline girder 40. Viewed planwise as shown in FIG. 4, centerline girder 40 is interposed between longitudinal openings 44, each of which is bounded by a lateral girder 42.

Figure 5:
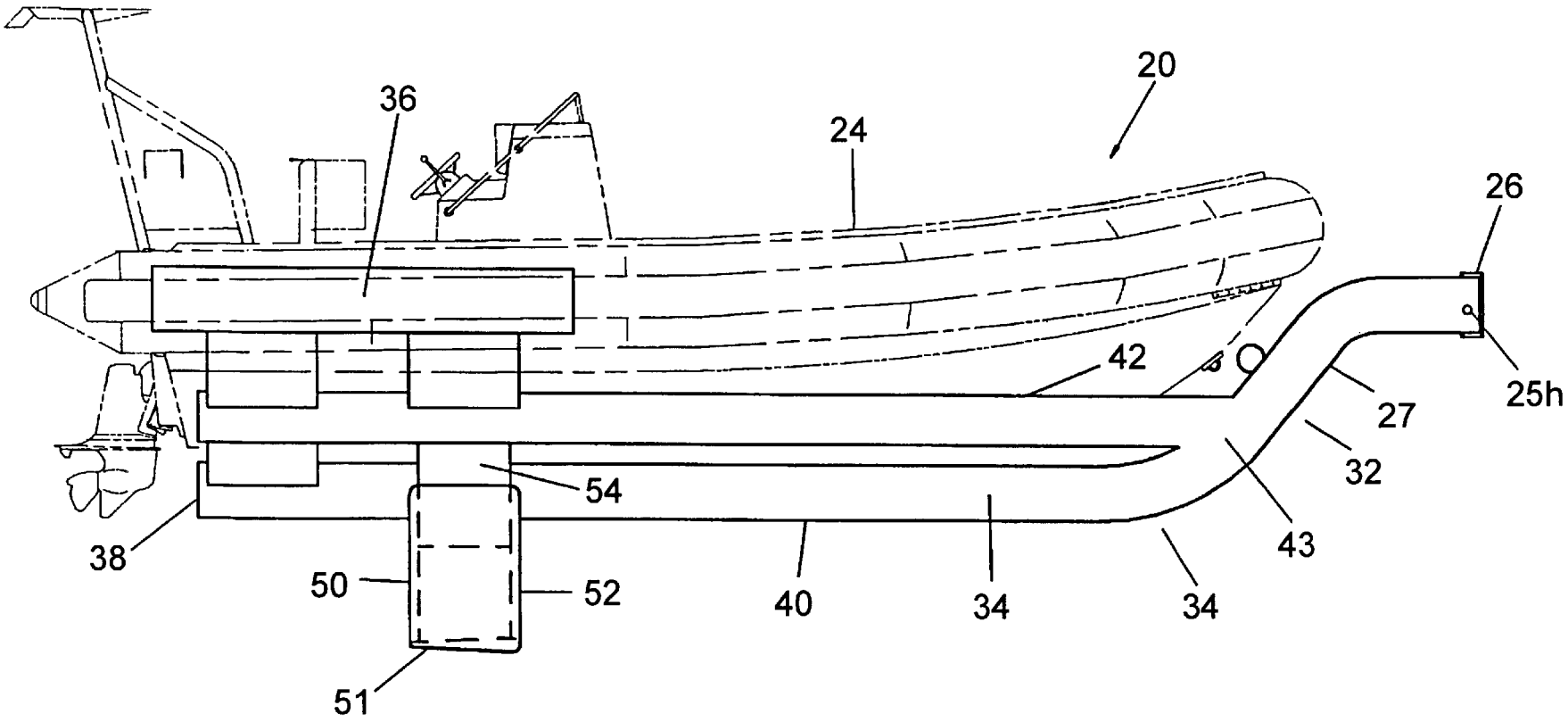
FIG. 5 is diagrammatic elevational side view (similar to the view shown in FIG. 3) of the inventive embodiment shown in FIG. 3, wherein the trailer vehicle is shown carrying cargo.
Figure 6:
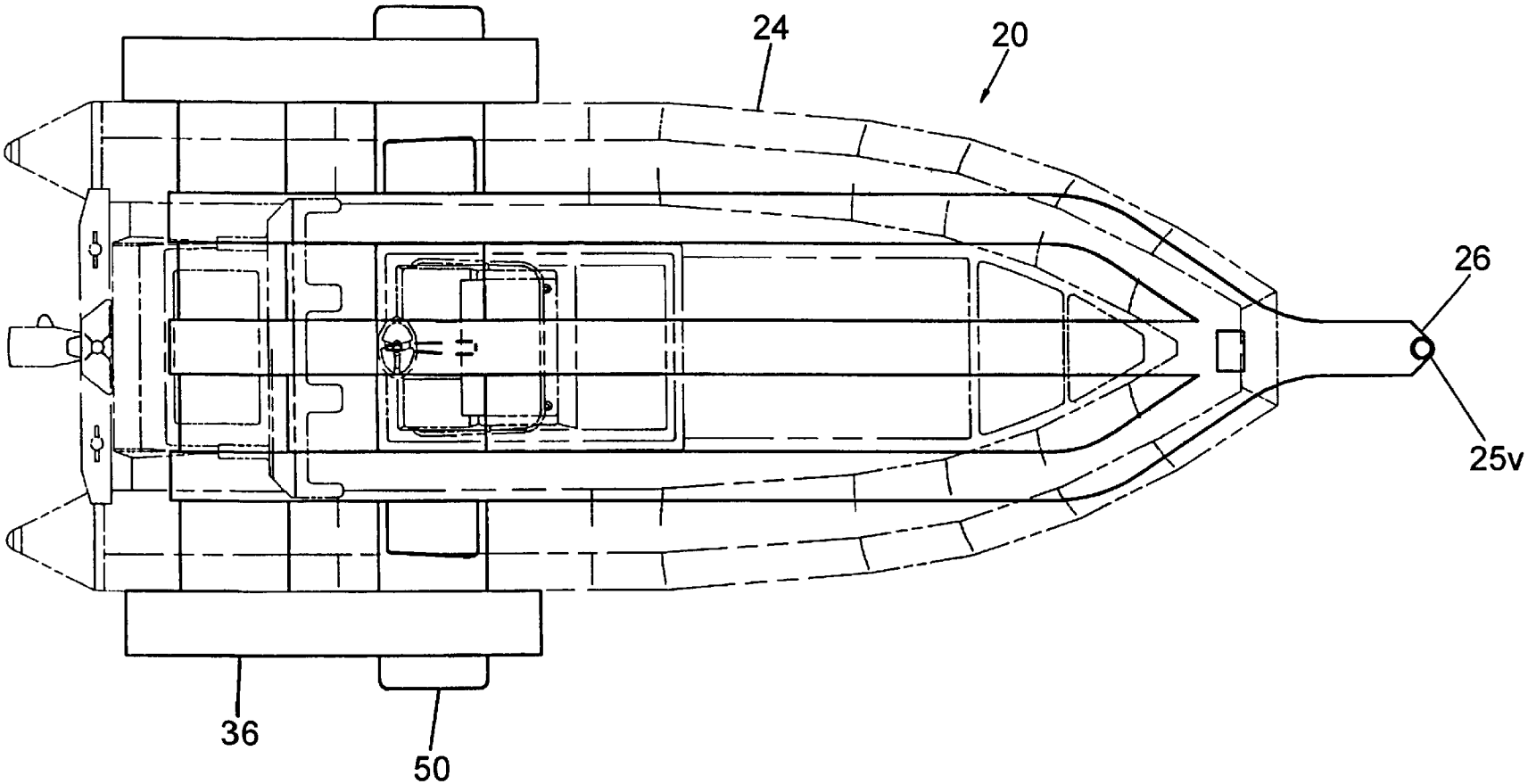
FIG. 6 is a diagrammatic top plan view (similar to the view shown in FIG. 4) of the inventive embodiment shown in FIG. 3, wherein the trailer vehicle is shown carrying the cargo as shown in FIG. 5.

As the plan view in FIG. 4 illustrates, while centerline girder 40 continues linearly in the forward direction, the two lateral girders 42 converge toward and eventually merge with centerline girder 40 at junction 43, located at the forward end of hullform 32. As the profile views in FIG. 3 and FIG. 5 illustrate, in parallel fashion in forward half 21 of trailer vehicle 20, the two lateral girders 42 begin at a certain point to curve upward, then continue to curve upward as they approach then meet at junction 43.

Viewed elevationally crosswise as shown in FIG. 7, bottom 34 is characterized by a conventional "V"-shape which is defined by centerline girder 40, the two openings 44 and the two lateral girders 42. It is seen that centerline girder 40 is positionally lower than are the two lateral girders 42. In terms of a "V"-shaped geometric "angle" conceived as having two geometric "sides" which meet at a geometric "vertex" pointing downward, centerline girder 40 can be considered to correspond to the lower vertex, and lateral girders 42 can be considered to correspond to the upper endpoints of the two sides.

The upper surfaces of girders 40 and 42 are in conformity with the cargo 24 intended to be carried. As shown in FIG. 7, centerline girder 40 has a horizontal upper surface 46, whereas lateral girders 42 each have an oblique upper surface 48, thereby accommodating the boat-type form of cargo 24. It is thus seen that girders 40 and 42 not only are structural members of trailer vehicle 20, but additionally serve to support cargo 24 in a manner akin to bunks, boards or panels or other such objects which are conventionally disposed above a surface to facilitate carriage. Moreover, as discussed hereinbelow, the open configuration of bottom 34 facilitates floating operations.

Reference now being made to FIG. 8 through FIG. 10, again trailer vehicle 20 includes hullform 32 and hydrofoil configuration 50. Hullform 32 includes hull bottom 34, hull sides 36 and hull transom 38. Hydrofoil configuration 50 includes hydrofoil unit 51 and struts 54. Cargo 24 is a submersible. Medial demarcation 95 (shown in FIG. 8 separates forward half 21 and aft half 23. Hydrofoil unit 51 includes hydrofoils 52, which is located in aft half 23.

Hullform 32 shown in FIG. 3 through FIG. 7 similarly defines the form a V-bottomed boat hull, but hullform 32 shown in FIG. 8 through FIG. 10 is more akin to that of a V-bottomed boat hull. As distinguished from the "open" hull bottom 34 shown in FIG. 3 through FIG. 7, hull bottom 34 shown in FIG. 8 through FIG. 10 is "closed." As best shown in FIG. 10, bottom 34 has a "closed" configuration in the sense of lacking any interstices (e.g., interspersed gaps or spaces); as thus viewed from above, bottom 34 appears to be continuous or unbroken.

Transom 38 shown in FIG. 3 through FIG. 10 is deemed "open" in a sense which differs from that in which bottom 34 is "open." Hullform 32 is open-backed in a manner akin to an open-backed sandal or slipper. The transom 38 structure essentially consists merely in the transverse horizontality which is approximately even with bottom 34 and which is located at the extreme stern of hullform 32.

Sides 36 shown in FIG. 3 through FIG. 10 are "open" regions in a sense similar to that in which bottom 34 is "open." Each side 36 is characterized by some degree of openness as well as some degree of structure including a post-and-rail assembly 33.

Each of the two (port and starboard) post-and-rail assemblies 33 shown in FIG. 3 through FIG. 7 includes a horizontal rail 35 and a pair of vertical posts 37. Sides 36 are situated in the back half of hullform 32. For each pair of posts 37, the more forward post 37 is shown to be in vertical alignment with hydrofoil 52. Sides 36 shown in FIG. 3 through FIG. 7 are hence "open" in a similar sense in which bottom 34 is "open": The side 36 regions of hullform 32 each contain one or more openings or interstices. Each post-and-rail assembly 33 defines and abuts side openings 39.

Similarly, each of the two (port and starboard) sides 36 shown in FIG. 8 through FIG. 10 includes an oblique rail 35 (moderately angled upward in the aft direction) and a pair of vertical posts 37. Here, sides 36 are situated in the front half of hullform 32. Again, sides 36 shown in FIG. 8 through FIG. 10 are "open" in a similar sense in which bottom 34 is "open."

Still referring to FIG. 8 through FIG. 10 and again referring to FIG. 3 through FIG. 7, hydrofoil configuration 50 is a typical "surface piercing" hydrofoil configuration. Hydrofoil configuration 50 is designated "surface piercing" because, normally when trailer vehicle 20 is "on foil," upper hydrofoil portions 56 of hydrofoil 52 ride above water surface 60, whereas lower hydrofoil portion 58 of hydrofoil 52 rides below water surface 60.

Hydrofoil configuration 50 includes a single "V"-shaped hydrofoil 52 and a plurality of struts 54. The "V" shape of hydrofoil 52 is shown to be in congruity with the "V" shape of hull bottom 34. Three struts 54 (a medial strut 54M and two lateral struts 54L) couple hydrofoil 52 with hullform 32, each strut 54 perpendicularly engaging bottom 34 at the upper end of strut 34 and perpendicularly engaging hydrofoil 52 at the lower end of strut 34. As shown in FIG. 7, medial strut 54M is connected to centerline girder 40; each lateral strut $54_L$ is connected to a lateral girder 42.

Generally speaking, the surface piercing hydrofoil configuration is a popular design due to its simplicity and natural stability. When lift is lost, the surface piercing hydrofoil inherently stabilizes the craft; the sinking of the craft into the water results in immersion of more of the foil (i.e., increase of the wetted area of the foil), thereby increasing the lift. The hydrofoil also inherently stabilizes the craft when the speed of the craft increases, so that the lift increases; the raising of the craft out of the water results in immersion of less of the foil (i.e., reduction of the wetted area of the foil), thereby reducing the lift. Again, the principle applies when the craft begins to roll to one side or when the craft pitches downward: Additional lift is generated by immersion of increased foil area, restoring the craft to even keel or to normal height.

Now referring to FIG. 11 and FIG. 12, hydrofoil configuration 50 is a typical "fully submerged" hydrofoil configuration. Here hydrofoil unit 51 includes two hydrofoils 52. Struts 54, which join hullform 32 with hydrofoils 52, pierce water surface 60; however, the two hydrofoils 52 do not pierce water surface 60. Fully submerged hydrofoil configuration 50 shown in FIG. 11 is of the "split" type, i.e., wherein the hydrofoil portion is separated into two discrete hydrofoils 52, each of which is located in aft half 23. Fully submerged hydrofoil configuration 50 shown in FIG. 12 is of the "non-split" type, i.e., wherein the hydrofoil portion constitutes a single hydrofoil 52, which is located in aft half 23.

In accordance with typical fully submerged hydrofoil designs, only the vertical struts pierce the water surface. A fully submerged hydrofoil hydrofoil system is not self-stabilizing. In calm waters a surface piercing system performs well, but in heavy sea conditions its natural stability can be counterproductive. By comparision, a fully submerged hydrofoil system effectively "platforms" the waves (maintains a level path); a fully submerged hydrofoil system accomplishes this by changing the angle of attack, or by manipulating flaps and elevators, with respect to one or more foils—thereby effecting changes in lift. Some fully submerged hydrofoil systems are not unlike the control systems of some modern aircraft.

Reference now being made to FIG. 13, hydrofoil configuration 50 is a typical "shallowly submerged" hydrofoil configuration. Struts 54 join trailer vessel 20 with hydrofoil unit 51, which is located in aft half 23. Hydrofoil unit 51 includes two hydrofoils 52, one of which is situated above the other. In operative principle, the shallowly submerged type of hydrofoil configuration is closely related to the surface piercing type of hydrofoil configuration.

With reference to FIG. 14 and FIG. 15, hydrofoil configuration 50 is a typical "ladder" hydrofoil configuration. Again, hydrofoil unit 51 (i.e., all of the hydrofoils 52) are located in aft half 23. Ladder hydrofoil configuration 50 shown in FIG. 14 is of the "split" type, i.e., wherein hydrofoil unit 51 is separated into two discrete sets 86 of at least two parallel hydrofoils 52. Ladder hydrofoil configuration 50 shown in FIG. 15 is of the "non-split" type, i.e., wherein hydrofoil unit 51 constitutes a single set 86 of at least two hydrofoils 52. Each set 86 of hydrofoils 52 represents a "ladder" having a pair of vertical struts 54 between which are the associated hydrofoils 52, wherein each hydrofoil 52 represents a "rung" on the "ladder."

The notion of "openness" versus "closedness" is therefore seen to be a manifest design aspect for hullform 32 of trailer vehicle 20. The design of hullform 32 has much to do with the nature of the cargo contemplated for transport. Trailer vehicle 20 shown in FIG. 11 through FIG. 15 is completely "closed"—that is, bottom 3,4 is closed, sides 36 are each closed, and transom 38 is closed. Hullform 32 shown in FIG. 11 through FIG. 15 is especially suitable for transport of cargo 24 which is "dry" (such as pallets, containers, etc.), and is not unlike that of some existing transport boats conventionally used for such transportative purposes.

It is apparent that the more "open" design exhibited by hullform 32 which is shown in FIG. 3 through FIG. 10 is particularly appropriate for transporting various kinds of water craft; marine vessels are inherently buoyant and hence lend themselves to being floated on and off a hullform 32 which permits such exercise. The "openness" of transom 38 is a particularly important design feature for permitting such cargo flotation practices. By contrast, the completely "closed" design exhibited by hullform 32 which is shown in FIG. 11 through FIG. 15 is particularly appropriate for transporting various kinds of dry cargo.

Many inventive applications involve the "floating on" and "floating off" of cargo in relation to trailer vehicle 20. Buoyant sections of hull bottom 34 and other parts of trailer vehicle 20 can be "flooded" to aid in float-on and float-off operations. If bottom 34 has an open configuration (such as shown in FIG. 3 through FIG. 7), the flooded section(s) can be drained by gravity when trailer vehicle 20 becomes "on foil." If bottom 34 has a closed configuration (such as shown in FIG. 8 through FIG. 10), the flooded section(s) can be drained by conventional mechanical means. Natural drainage versus mechanical drainage can therefore be viewed as representing an advantage of an open bottom 34 vis-a-vis' a closed bottom 34.

In floating operations, a to-be-transported marine craft can be caused to float, entirely on its own power, into or onto trailer vehicle 20. Some inventive embodiments may provide a boosting device such as includes a crane, a hoist, a winch, a pulley, powered wheels or similar apparatus. For instance, marine craft (boats, submersibles, etc.) can be pulled onto trailer vehicle 20 and/or secured thereon using trailer winch 55 shown in FIG. 8 and FIG. 9.

Besides more readily admitting of floating operations, there are other possible advantages of an open bottom 34 over a closed bottom 34. An "open" trailer vehicle 20 can be considered a class of inventive embodiment which advantageously reduces or minimizes the amount of structure of hullform 32, with a view to applications wherein the buoyancy of the transported marine craft itself will be relied upon to a significant extent while being transported by trailer vehicle 20.

Moreover, the structural form of an open bottom 34 such as shown in FIG. 3 through FIG. 7 is intrinsically "slatted" in a way which facilitates carriage of cargo 24. This obviates the need for auxiliary structure (boards, rollers, etc.), such as bunks 57 atop closed bottom 34 as best shown in FIG. 9 and FIG. 10, utilized for supporting cargo and/or facilitating placement of cargo.

In inventive practice, the towing of many kinds of cargo 24 (e.g., relatively large objects such as boats and submersibles) will require the effectuation of some sort of methodology for restraining, constraining or controlling cargo 24 with respect to trailer vehicle 20 in a manner appropriate for transport. The nature of restraint system 70 depends upon the type of cargo 24 being carried by trailer vehicle 20. Depending on the embodiment, restraint system 70 according to this invention can involve simple tie-downs or can involve more elaborate mechanics which are known in the art.

Restraint system 70 shown in FIG. 8 through FIG. 10 includes a laterally opposite pair of horizontal bars 72 and vertical supports 74. Bars 72 are structured and disposed in conformity with the shape of cargo 24 to be carried by trailer vehicle 20; in FIG. 8 through FIG. 10, bars 72 are adapted to the shape of submersible 24. By contrast, restraint system 70 is essentially or substantially incorporated into the structure of hullform 32 shown in FIG. 3 through FIG. 7 The shape of hullform 32 is adapted to the shape of boat 24; in particular, hullform 32 harmoniously provides a "V"-shaped bottom 34 and strategically placed sides 36 which cooperate to help constrain boat 24.

FIG. 3 through FIG. 7 thus exemplify how hullform 32 can be inventively made to "fit" cargo 24, in anticipation of the cargo 24 to be carried (cargo 24 being boat 24 in FIG.

3 through FIG. 7). In other words, hullform 32 inherently includes restraint system 70. Such agreement between hullform 32 and cargo 24 can thus reduce or obviate the need for supplemental apparatus which would serve as part of restraint system 70.

Whether hull bottom 34 of this invention is "open" or "closed," hull bottom 34 generally serves certain important purposes. Bottom 34 provides structural support for trailer vehicle 20 and load-bearing support for cargo 24. Furthermore, regardless of its form, bottom 34 to at least some extent contributes both hydrostatically and hydrodynamically to the seaworthiness of trailer vehicle 20. Prior to achievement by trailer vehicle 20 of a fully "on foil" condition, hull bottom 34 supports buoyancy (static), planing (dynamic) and hydrofoiling (dynamic).

A hull bottom 34 (an open bottom 34 more likely than a closed bottom 34) may be considered deficient in terms of stand-alone buoyancy. Therefore, for some inventive embodiments the buoyantly deficient bottom 34 is assisted in this regard by one or more hydrostatically enhancing members, such as flotation accessories 59 included in sides 36 as shown in FIG. 7. In this manner, a buoyantly deficient bottom 34 is capable of adequately floating in the water on its own in the absence of buoyant (marine vessel-type) cargo—not only when carrying such cargo, which contributes significantly to the overall buoyancy of trailer vessel 20.

Marked distinction can be drawn when comparing the present invention with customary hydrofoil methodologies. Hydrofoil craft are known in the art to normally comprise both a front foil configuration and a back foil configuration, wherein each foil configuration comprises at least one foil.

By way of elaboration, it is recalled that a middle planar delimitation can be imagined (namely, medial demarcation 95) which divides trailer vehicle 20 into a front half-section (namely, front half 21) and an aft half-section (namely, aft half 23). This delineative nomenclature can conveniently be applied to marine craft in general. Furthermore, the term "hydrofoil unit," previously introduced herein, is now used herein in a more general sense. "Hydrofoil unit" describes a singularity or plurality of hydrofoils which is discrete in reference to the medial demarcation; that is, a hydrofoil unit describes a grouping of at least one hydrofoil whereby every hydrofoil in the hydrofoil unit is situated in either the craft's front half or the craft's back half.

Hence, a typical (non-hybrid) hydrofoil craft provides two hydrofoil units 20 whereby one hydrofoil unit is situated before (forward of) the medial demarcation and the other hydrofoil unit is situated behind (aft of) the medial demarcation. With regard to typical hydrofoil craft, it is known practice to arrange two distinct hydrofoil configurations so that the hydrofoil unit corresponding to one hydrofoil configuration is situated in the front half-section of the craft and the hydrofoil unit corresponding to the other hydrofoil configuration is situated in the back half-section of the craft. There are three standard designations—viz., "conventional," "canard" and "tandem"—which vary in accordance with the arrangement of the front and back foils. These designations categorize hydrofoil arrangements on the basis of the respective amounts of weight which are supported on the front hydrofoil unit versus the aft hydrofoil unit.

Conventional hydrofoil arrangements and canard hydrofoil arrangements are analogous insofar as each arrangement provides for a major (primary) hydrofoil configuration (having a major hydrofoil unit associated therewith) and a minor (secondary) hydrofoil configuration (having a minor hydrofoil unit associated therewith); sixty-five percent or more of the weight of the hydrofoil craft is supported on the major hydrofoil unit, and thirty-five percent or less of the weight of the hydrofoil craft is supported on the minor hydrofoil unit.

In a conventional hydrofoil arrangement, the major hydrofoil configuration situates its associated foil unit in the front half of the craft (i.e., in front of the medial demarcation), while the minor hydrofoil configuration situates its associated foil unit in the back half of the craft (i.e., in back of the medial demarcation). Conversely, in a canard hydrofoil arrangement, the major hydrofoil configuration situates its associated foil unit in the back half of the craft (i.e., in back of the medial demarcation), while the minor hydrofoil configuration situates its associated foil unit in the front half of the craft (i.e., in front of the medial demarcation). Tandem hydrofoil arrangements provide for two equivalent hydrofoil configurations, one of which situates its associated foil unit in the back half of the craft (i.e., in back of the medial demarcation), the other of which situates its associated foil unit in the front half of the craft (i.e., in front of the medial demarcation).

A hydrofoil craft having a conventional foil arrangement has a center of gravity which is located forward of the medial demarcation; at least sixty-five percent of the weight of the craft is supported on the major hydrofoil unit, which is situated in the front half of the craft. A hydrofoil craft having a canard foil arrangement has a center of gravity which is located aft of the medial demarcation; at least sixty-five percent of the weight of the craft is supported on the major hydrofoil unit, which is situated in the back half of the craft. A hydrofoil craft having a tandem foil arrangement has a center of gravity which is located about or nearly even with the medial demarcation; the weight is distributed relatively equally (approximately "fifty-fifty") on the fore hydrofoil unit and the aft hydrofoil unit.

Trailer vehicle 20 in accordance with this invention can be thought of as a novel type of hydrofoil craft which is uniquely characterized by a "quasi-canard" hydrofoil arrangement—that is, a canard hydrofoil arrangement wherein the major hydrofoil unit is present in the back half section of the craft, but the minor hydrofoil unit (normally present in the front half section of the craft) is absent. In accordance with many embodiments of the inventive FAST, hydrofoil unit 51 (which comprises one or more hydrofoils 52) effectively constitutes the "major" hydrofoil unit, located in back half 23 of trailer vehicle 20; hydrofoil unit 51 supports a majority of the weight of trailer vehicle 20. The back end of tractor vehicle 22 effectively supplants the "minor" hydrofoil unit by supporting a minority of the weight of trailer vehicle 20. Tractor vehicle 22 additionally provides mechanical power and navigational control for the inventive FAST.

Other embodiments of this invention will be apparent to those skilled in the art from a consideration of this specification or practice of the invention disclosed herein. Various omissions, modifications and changes to the principles described may be made by one skilled in the art without departing from the true scope and spirit of the invention which is indicated by the following claims.

What is claimed is:

1. A towable water vehicle comprising a hullform, at least one hydrofoil and means for attaching said at least one hydrofoil to said hullform, said towable water vehicle having a transom and an imaginary planar bisector, said imaginary planar bisector dividing said towable water vehicle into a fore half section and an aft half section, said at least one hydrofoil being situated in said aft half section so that no portion of said at least one hydrofoil is situated in said fore half section and so that at least a portion of said at least one hydrofoil is inboard of said transom, said fore half section thereby being devoid of any portion of said at least one hydrofoil, wherein when said towable water vehicle is being towed in water at a sufficient steed said at least one hydrofoil is capable of generating lift so as to support more than fifty percent of the weight associated with said towable water vehicle, at least a substantial portion of said hullform being adaptable to carrying cargo, said weight associated with said towable water vehicle including the weight of said hullform and the weight of said cargo.

2. A towable water vehicle as in claim 1, wherein said hullform includes a hull bottom, wherein said transom is approximately even with said hull bottom, wherein said cargo includes a buoyant vessel, and wherein when said towable water vehicle is in water said hullform is adaptable to being loaded with said buoyant vessel via flotation of said buoyant vessel over said transom and aboard said hullform.

3. A towable water vehicle as in claim 1, wherein said hullform has a hull bottom which generally defines a "V" shape in cross-section, said hull bottom comprising a plurality of oblong members which are disposed substantially longitudinally so as to leave at least one interstice.

4. A towable water vehicle as in claim 1, wherein said hullform has a hull bottom which generally defines a "V" shape in cross-section and which is uninterrupted by an opening.

5. A towable water vehicle as in claim 1, wherein said hullform has a hull bottom which defines an upper surface, and wherein said transom has an upper rim which is approximately even with said upper surface.

6. A towable water vehicle as in claim 1, wherein said hullform has a hull bottom which defines an upper surface, and wherein said transom has an upper rim which is substantially higher than said upper surface.

7. A towable water vehicle as in claim 1, wherein said at least one hydrofoil is a hydrofoil unit selected from the group consisting of surface piercing hydrofoil unit, fully submerged hydrofoil unit, shallowly submerged hydrofoil unit and ladder hydrofoil unit, and wherein said ladder hydrofoil unit includes at least two said hydrofoils in a ladder arrangement.

8. A towable water vehicle as in claim 1, wherein said at least one hydrofoil is completely inboard of said transom.

9. For marine use, the combination of a tractor vehicle, a trailer vehicle and means for closely and semi-rigidly connecting said tractor vehicle and said trailer vehicle so as to provide at least one degree of freedom of said trailer vehicle with respect to said tractor vehicle, said tractor vehicle having a tractor vehicle back end, paid trailer vehicle having a trailer vehicle front end, wherein said means for closely and semi-rigidly connecting engages said tractor vehicle back end and said trailer vehicle front end, said trailer vehicle including a hull, at least one hydrofoil and at least one strut, wherein said at least one strut joins said at least one hydrofoil with said hull, said hull having a stern, said trailer vehicle being characterized by an imaginary longitudinal axis, an imaginary medial vertical plane and an imaginary aft-end vertical plane, said imaginary medial vertical plane being perpendicular to said imaginary longitudinally axis and bisecting said trailer vehicle, said imaginary aft-end vertical plane being perpendicular to said imaginary longitudinal axis and delimiting said trailer vehicle at the aft-most periphery of said stern, at least a part of said at least one hydrofoil being positioned between said imaginary medial vertical plane and said imaginary aft-end vertical plane, no part of said at least one hydrofoil being positioned before said imaginary medial vertical plane, no more than a part of said at least one hydrofoil being positioned behind said imaginary aft-end vertical plane, wherein said combination is capable of attaining a lift-generating navigational speed, said at least one hydrofoil thereby generating lift so as to support more than half of the weight associated with said trailer vehicle, and wherein said combination is adaptable to transporting cargo at least a substantial portion of said hull having the capacity for carrying said cargo, said weight associated with said trailer vehicle including the weight of said hull and the weight of said cargo.

10. The combination as in claim 9, wherein said hull includes a hull bottom, wherein said stern is approximately even with said hull bottom, wherein said cargo includes a buoyant vessel, and wherein when said trailer vehicle is in water said hull is adaptable to being loaded with said buoyant vessel via flotation of said buoyant vessel over said stern and aboard said hull.

11. The combination as in claim 9, wherein said tractor vehicle includes mechanical power means and navigational control means, and wherein said combination is capable of sustaining said lift-generating navigational speed of at least ten knots.

12. The combination as in claim 9, wherein said at least one hydrofoil has a configuration selected from the group consisting of surface piercing configuration, fully submerged configuration, shallowly submerged configuration and ladder configuration.

13. The combination as in claim 9, wherein said trailer vehicle comprises means for restraining said cargo.

14. The combination as in claim 9, wherein no part of said at least one hydrofoil is positioned behind said imaginary aft-end vertical plane.

15. The combination as in claim 9, wherein said at least one degree of freedom includes lateral movability.

16. The combination as in claim 9, wherein said means for closely and semi-rigidly connecting includes stiff elastomeric material.

17. A method for effecting marine transportation of at least one entity, said method comprising:

providing a tractor vehicle;

providing a trailer vehicle which includes a hull, at least one hydrofoil and at least one strut, wherein said at least one strut joins said at least one hydrofoil with said hull, said trailer vehicle having a transom and an imaginary planar bisector, said imaginary planar bisector dividing said trailer vehicle into a fore semi-section and an aft semi-section, said at least one hydrofoil being situated in said aft semi-section so that no portion of said at least one hydrofoil is situated in said fore semi-section and so that at least a portion of said at least one hydrofoil is inboard of said transom, said fore semi-section thereby being devoid of any portion of said at least one hydrofoil, at least a substantial portion of said hullform being adaptable to carrying said at least one entity;

closely and semi-rigidly connecting said tractor vehicle and said trailer vehicle so as to provide at least one degree of freedom of said trailer vehicle with respect to said tractor vehicle, said tractor vehicle having a tractor vehicle back end, said trailer vehicle having a trailer vehicle front end, said connecting including engaging said tractor vehicle at said tractor vehicle back end and engaging said trailer vehicle at said trailer vehicle front end;

loading said at least one entity onto said trailer vehicle; and towing said trailer vehicle in water using said tractor vehicle, said towing including attaining a sufficient speed so that said at least one hydrofoil generates lift and thereby supports more than half of the weight associated with said trailer vehicle, said weight associated with said trailer vehicle including the weight of said hull and the weight of said at least one entity.

18. A method for effecting marine transportation as in claim 16, wherein said providing a trailer vehicle comprises making said trailer vehicle, said making including:

providing said hull;

providing said at least one hydrofoil;

providing said at least one strut; and joining said at least one hydrofoil with said hull, said joining including using said at least one strut.

19. A method for effecting marine transportation as in claim 16, wherein said hull includes a hull bottom, wherein said transom is approximately even with said hull bottom, wherein said at least one entity includes a buoyant vessel, wherein said loading includes floating said buoyant vessel over said transom and onto said trailer vehicle, wherein said method comprises unloading said at least one entity from said trailer vehicle, and wherein said unloading includes floating said buoyant vessel over said transom and off said trailer vehicle.

20. A method for effecting marine transportation as in claim 17, wherein said at least one hydrofoil is entirely inboard of said transom.

* * * * *